US011259684B2

(12) United States Patent
Delellis et al.

(10) Patent No.: US 11,259,684 B2
(45) Date of Patent: Mar. 1, 2022

(54) DISHWASHER

(71) Applicant: Whirlpool Corporation, Benton Harbor, MI (US)

(72) Inventors: Thomas M. Delellis, Saint Joseph, MI (US); Mark S. Feddema, Kalamazoo, MI (US); Alvaro Vallejo Noriega, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 112 days.

(21) Appl. No.: 16/154,286

(22) Filed: Oct. 8, 2018

(65) Prior Publication Data

US 2019/0038109 A1 Feb. 7, 2019

Related U.S. Application Data

(63) Continuation of application No. 14/804,709, filed on Jul. 21, 2015, now Pat. No. 10,136,793.

(60) Provisional application No. 62/027,832, filed on Jul. 23, 2014.

(51) Int. Cl.
*A47L 15/48* (2006.01)

(52) U.S. Cl.
CPC ..... *A47L 15/486* (2013.01); *A47L 15/483* (2013.01); *A47L 15/488* (2013.01)

(58) Field of Classification Search
CPC ..... A47L 15/483; A47L 15/486; A47L 15/488
See application file for complete search history.

(56) References Cited

U.S. PATENT DOCUMENTS

| | | | |
|---|---|---|---|
| 3,026,628 | A | 3/1962 | Berger, Sr. et al. |
| 3,068,877 | A | 12/1962 | Jacobs |
| 3,807,420 | A | 4/1974 | Donselman et al. |
| 3,876,469 | A | 4/1975 | Schimke |
| 4,326,552 | A | 4/1982 | Bleckmann |

(Continued)

FOREIGN PATENT DOCUMENTS

| | | | |
|---|---|---|---|
| CH | 693494 | A5 | 9/2003 |
| DE | 3418304 | A1 | 11/1985 |

(Continued)

OTHER PUBLICATIONS

German Search Report for Counterpart DE102012025591.8, dated May 2, 2013.

(Continued)

*Primary Examiner* — Jorge A Pereiro
*Assistant Examiner* — Logan P Jones
(74) *Attorney, Agent, or Firm* — McGarry Bair PC

(57) ABSTRACT

A dishwasher includes a tub having an air outlet, an airflow conduit fluidly coupling the tub air outlet to ambient air, a blower assembly forcing air to flow from the tub and through the tub air outlet into the airflow conduit, a first reservoir associated with the airflow conduit and collecting liquid condensed from the air forced through the airflow conduit, the first reservoir fluidly coupled to the tub for draining the collected liquid into the tub, and a second reservoir associated with the airflow conduit downstream of the first reservoir and collecting liquid condensed from the air prior to the exhaustion of the air to the ambient air, wherein any liquid not collected by the first reservoir is collected by the second reservoir for evaporation.

18 Claims, 18 Drawing Sheets

(56) References Cited

U.S. PATENT DOCUMENTS

| | | | | |
|---|---|---|---|---|
| 5,056,543 | A * | 10/1991 | Dygve | A47L 15/483 134/107 |
| 5,277,210 | A | 1/1994 | Kim | |
| 5,337,500 | A | 8/1994 | Enokizono | |
| 5,341,827 | A | 8/1994 | Kim | |
| 5,875,802 | A | 3/1999 | Favaro et al. | |
| 5,881,746 | A | 3/1999 | Buser et al. | |
| 6,578,591 | B1 | 6/2003 | Eksert et al. | |
| 7,445,013 | B2 | 11/2008 | VanderRoest et al. | |
| 7,523,758 | B2 | 4/2009 | VanderRoest et al. | |
| 7,594,513 | B2 | 9/2009 | Vanderroest et al. | |
| 7,798,157 | B2 * | 9/2010 | Kim | A47L 15/486 134/107 |
| 7,909,939 | B2 * | 3/2011 | Brewer | A47L 15/483 134/56 D |
| 8,161,986 | B2 | 4/2012 | Alessandrelli | |
| 8,469,043 | B2 | 6/2013 | Tolf | |
| 8,496,760 | B2 | 7/2013 | Bertsch et al. | |
| 8,696,824 | B2 * | 4/2014 | Jadhav | A47L 15/0034 134/25.2 |
| 8,758,525 | B2 * | 6/2014 | Kim | A47L 15/486 134/105 |
| 8,887,742 | B2 | 11/2014 | Eiermann et al. | |
| 9,351,628 | B2 * | 5/2016 | Erozkan | A47L 15/486 |
| 2003/0140517 | A1 | 7/2003 | Schmid | |
| 2006/0096621 | A1 | 5/2006 | Lee et al. | |
| 2006/0236556 | A1 | 10/2006 | Ferguson et al. | |
| 2007/0251552 | A1 | 11/2007 | Lee | |
| 2008/0210279 | A1 | 9/2008 | Hildenbrand | |
| 2008/0264455 | A1 * | 10/2008 | Brewer | A47L 15/488 134/95.2 |
| 2008/0264458 | A1 | 10/2008 | Brewer et al. | |
| 2009/0038661 | A1 | 2/2009 | Hildenbrand | |
| 2009/0266385 | A1 * | 10/2009 | Haltmayer | A47L 15/483 134/104.4 |
| 2010/0043250 | A1 | 2/2010 | Berends et al. | |
| 2010/0192977 | A1 * | 8/2010 | Jadhav | A47L 15/0034 134/18 |
| 2010/0294323 | A1 | 11/2010 | Brunswick et al. | |
| 2010/0300499 | A1 * | 12/2010 | Han | A47L 15/483 134/172 |
| 2011/0126864 | A1 | 6/2011 | Kim | |
| 2012/0138107 | A1 | 6/2012 | Fountain et al. | |
| 2013/0152981 | A1 * | 6/2013 | Bertsch | A47L 15/0013 134/105 |
| 2014/0165421 | A1 | 6/2014 | Jadhav et al. | |
| 2014/0360534 | A1 * | 12/2014 | Olson | A47L 15/488 134/25.2 |
| 2015/0257627 | A1 * | 9/2015 | Park | A47L 15/483 34/72 |

FOREIGN PATENT DOCUMENTS

| | | | | |
|---|---|---|---|---|
| DE | 4230576 | A1 | 3/1994 | |
| DE | 19934121 | A1 * | 2/2000 | A47L 15/0013 |
| DE | 19946456 | A1 | 4/2001 | |
| DE | 10058188 | A1 | 5/2002 | |
| DE | 102006042486 | B3 | 11/2007 | |
| DE | 102007007133 | A1 | 8/2008 | |
| DE | 102008040745 | A1 | 1/2010 | |
| DE | 102010002086 | A1 | 8/2011 | |
| DE | 102010029888 | A1 | 12/2011 | |
| EP | 0374616 | A1 | 6/1990 | |
| EP | 0536621 | A1 * | 4/1993 | A47L 15/483 |
| EP | 1013217 | A1 | 6/2000 | |
| EP | 1097669 | A2 | 5/2001 | |
| EP | 1447042 | A1 | 8/2004 | |
| EP | 2075366 | A1 | 7/2009 | |
| EP | 2332457 | A1 | 6/2011 | |
| FR | 2491320 | A1 | 4/1982 | |
| FR | 2491321 | A1 | 4/1982 | |
| JP | 1005521 | A | 1/1989 | |
| JP | 2008279026 | A | 11/2008 | |
| KR | 20050014516 | A | 2/2005 | |
| KR | 101290098 | B1 | 8/2013 | |
| WO | 2009008828 | A1 | 1/2009 | |
| WO | 2010073185 | A1 | 7/2010 | |
| WO | 2011147683 | A1 | 12/2011 | |
| WO | 2013042036 | A1 | 3/2013 | |
| WO | WO-2014169704 | A1 * | 10/2014 | A47L 15/483 |

OTHER PUBLICATIONS

German Search Report for Counterpart DE102012109784.4, dated Apr. 29, 2013.

* cited by examiner

DISHWASHER

CROSS-REFERENCE TO RELATED APPLICATION

The present application is a continuation of U.S. patent application Ser. No. 14/804,709, filed Jul. 21, 2015, now U.S. Pat. No. 10,136,793, issued on Nov. 27, 2018, which claims the benefit of U.S. Provisional Patent Application No. 62/027,832, filed Jul. 23, 2014, all of which are incorporated herein by reference in their entirety.

BACKGROUND

Some domestic dishwashers include an air supply system that provides ambient air into the dishwasher tub during a drying step to aid in drying the wet dishes. To avoid leakage of the air, which becomes humid in the tub, at undesirable locations, some dishwashers also include an air exhaust system that directs the air from the tub to the atmosphere external to the dishwasher at a desired location. The exhaust air may pass through a condenser to remove some of the moisture from the air prior to being released into the atmosphere.

SUMMARY

An aspect of the disclosure relates to a dishwasher including a tub having an open face and at least partially defining a treating chamber receiving dishes for treatment and having a tub air outlet and a tub air inlet, an airflow conduit fluidly coupling the tub air outlet to ambient air, a blower assembly forcing air to flow from the tub through the tub air outlet into the airflow conduit, a first reservoir associated with the airflow conduit, the first reservoir configured for collecting liquid condensed from the air forced through the airflow conduit and defining an open reservoir having a liquid outlet fluidly coupled to the tub and configured for draining collected liquid in the open reservoir into the tub, and a second reservoir associated with the airflow conduit, the second reservoir configured for collecting liquid condensed from the air forced through the airflow conduit and defining a closed reservoir configured for emptying collected liquid via evaporation.

Another aspect of the disclosure relates to a dishwasher including a tub having an open face and at least partially defining a treating chamber receiving dishes for treatment and having a tub air outlet, a spray system configured to spray liquid into the dishwasher, an airflow conduit comprising an inlet section fluidly coupling ambient air to the treating chamber through a tub air inlet formed in the tub and an outlet section fluidly coupling the tub air outlet to ambient air, a blower assembly forcing air to flow from the tub and through the tub air outlet into the outlet section, a first reservoir within the outlet section of the airflow conduit, the first reservoir configured to collect liquid condensed air forced through the outlet section, the first reservoir fluidly coupled to the tub and configured for draining the collected liquid into the tub, and a second reservoir within the airflow conduit downstream of the first reservoir and configured to collect any liquid not collected by the first reservoir for evaporation prior to exhaustion of the air to the ambient air.

DETAILED DESCRIPTION

Aspects of the present disclosure are generally directed toward the air system of a dishwasher. The particular approach of the embodiments of the invention disclosed herein is to provide an air system with multiple reservoirs for managing the collection of condensation from air flowing through the system.

Figure 1:
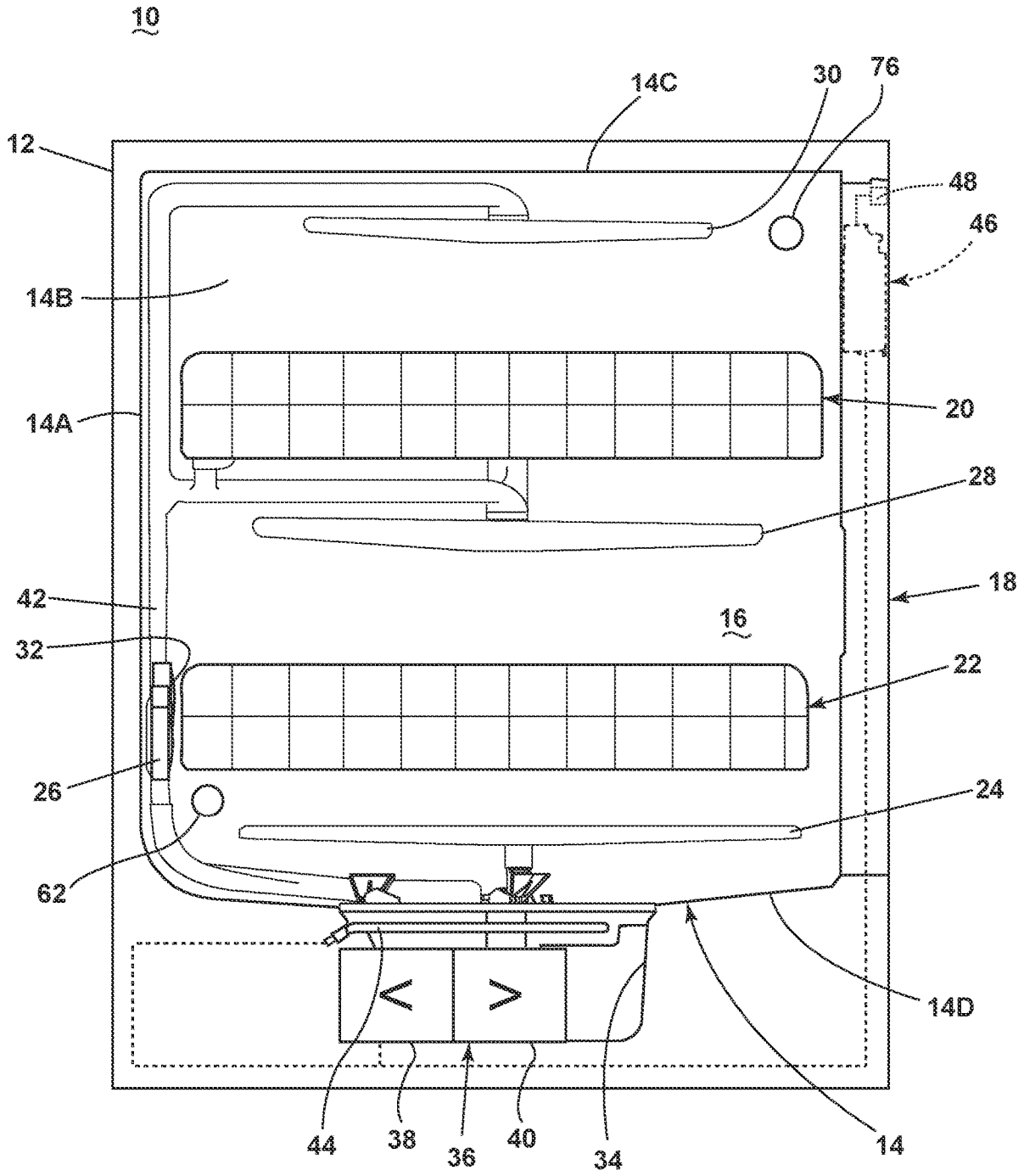
FIG. 1 is a schematic, cross-sectional view of an exemplary dishwasher.

FIG. 1 schematically illustrates an exemplary automated dishwasher 10 according to a first embodiment. The dishwasher 10 shares many features of a conventional automated dishwasher, which will not be described in detail herein except as necessary for a complete understanding of the invention. A chassis 12 may define an interior of the dishwasher 10 and may include a frame, with or without panels mounted to the frame. An open-faced tub 14 may be provided within the chassis 12 and may at least partially define a treating chamber 16, having an open face, for washing dishes. The tub 14 may include a rear wall 14A, opposing side walls 14B, a top wall 14C, and a bottom wall 14D, and the front edges of the side walls 14B, the top wall 14C, and the bottom wall 14D form the open face of the tub 14. A door assembly 18 may be movably mounted to the dishwasher 10 for movement between opened and closed positions to selectively open and close the open face of the tub 14. Thus, the door assembly 18 provides accessibility to the treating chamber 16 for the loading and unloading of dishes or other washable items.

It should be appreciated that the door assembly 18 may be secured to the lower front edge of the chassis 12 or to the lower front edge of the tub 14 via a hinge assembly (not shown) configured to pivot the door assembly 18. When the door assembly 18 is closed, user access to the treating chamber 16 may be prevented, whereas user access to the treating chamber 16 may be permitted when the door assembly 18 is open. Alternatively, the closure element may be slidable relative to the chassis 12, such as in a drawer-type dishwasher, wherein the access opening for the treating chamber 16 is formed by an open face of an open-top tub. Other configurations of the closure element relative to the chassis 12 and the tub 14 are also within the scope of the invention.

Dish holders, illustrated in the form of upper and lower dish rack assemblies 20, 22, are located within the treating chamber 16 and receive dishes for treatment, such as washing. The upper and lower rack assemblies 20, 22 are typically mounted for slidable movement in and out of the treating chamber 16 for ease of loading and unloading. Other dish holders may be provided, such as a silverware basket, separate from or combined with the upper and lower rack assemblies 20, 22. As used in this description, the term "dish(es)" is intended to be generic to any item, single or plural, that may be treated in the dishwasher 10, including, without limitation, dishes, plates, pots, bowls, pans, glassware, and silverware.

A spray system may be provided for spraying liquid in the treating chamber 16 and may be provided in the form of, for example, a first lower spray assembly 24, a second lower spray assembly 26, a mid-level spray assembly 28, and/or an upper spray assembly 30. The upper spray assembly 30, the mid-level spray assembly 28, and the first lower spray assembly 24 are located, respectively, above the upper rack assembly 20, beneath the upper rack assembly 20, and beneath the lower rack assembly 22 and are illustrated as rotating spray arms by example but are not limited to such positions and sprayer type. The second lower spray assembly 26 is illustrated as being located adjacent the lower dish rack assembly 22 toward the rear of the treating chamber 16. The second lower spray assembly 26 is illustrated by example as including a vertically oriented distribution header or spray manifold 32. An exemplary spray manifold is set forth in detail in U.S. Pat. No. 7,594,513, issued Sep. 29, 2009, and titled "Multiple Wash Zone Dishwasher," which is incorporated herein by reference in its entirety.

A recirculation system may be provided for recirculating liquid from the treating chamber 16 to the spray system. The recirculation system may include a sump 34 and a pump assembly 36. The sump 34 collects the liquid sprayed in the treating chamber 16 and may be formed by a sloped or recess portion of the bottom wall 14D of the tub 14. The pump assembly 36 may include both a drain pump 38 and a recirculation pump 40. The drain pump 38 may draw liquid from the sump 34 and pump the liquid out of the dishwasher 10 to a household drain line (not shown). The recirculation pump 40 may draw liquid from the sump 34, and the liquid may be simultaneously or selectively pumped through a supply tube 42 to each of the spray assemblies 24, 26, 28, 30 for selective spraying. While not shown, a liquid supply system may include a liquid supply conduit coupled with a liquid supply, such as a household water supply, for supplying water or other liquid to the treating chamber 16.

A heating system including a heater 44 may be located, for example, within the sump 34 for heating the liquid contained in the sump 34. While not shown, the heating system may include other heating devices, such as a steam generator.

A controller 46 may also be included in the dishwasher 10, which may be operably coupled with various components of the dishwasher 10 to implement a cycle of operation. The controller 46 may be located within the door assembly 18 as illustrated, or it may alternatively be located somewhere within the chassis 12. The controller 46 may also be operably coupled with a control panel or user interface 48 for receiving user-selected inputs and communicating information to the user. The user interface 48 may include operational controls such as dials, lights, switches, and displays enabling a user to input commands, such as a cycle of operation, to the controller 46 and receive information.

Figure 2:
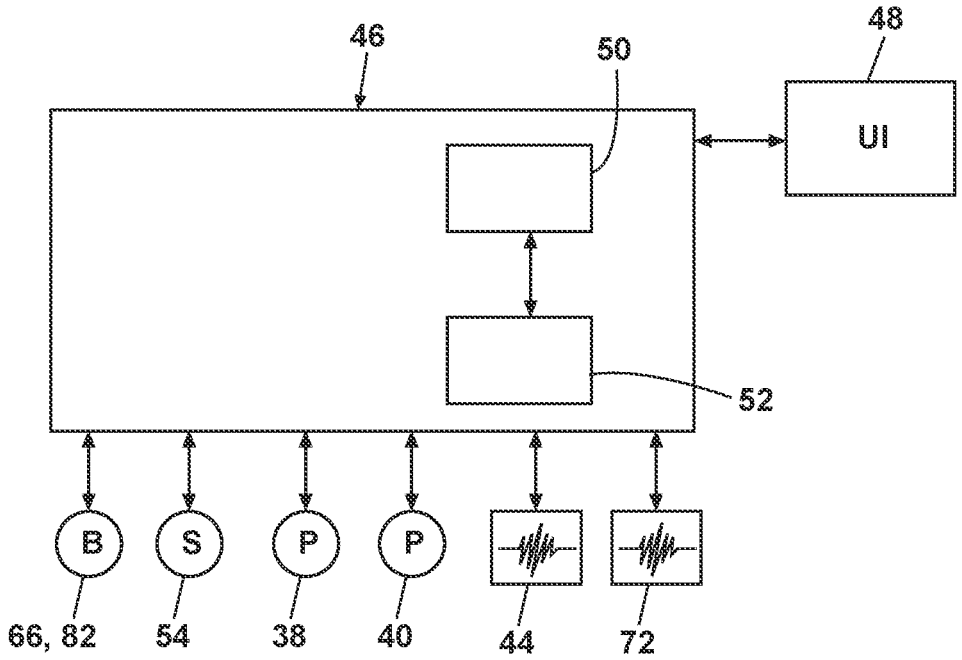
FIG. 2 is a schematic view of a controller of the dishwasher of FIG. 1.

As illustrated schematically in FIG. 2, the controller 46 may be coupled with the heater 44 for heating the wash liquid during a cycle of operation, the drain pump 38 for draining liquid from the treating chamber 16, and the recirculation pump 40 for recirculating the wash liquid during the cycle of operation. The controller 46 may be provided with a memory 50 and a central processing unit (CPU) 52. The memory 50 may be used for storing control software that may be executed by the CPU 52 in completing a cycle of operation using the dishwasher 10 and any additional software. For example, the memory 50 may store one or more pre-programmed cycles of operation that may be selected by a user and completed by the dishwasher 10. The controller 46 may also receive input from one or more sensors 54. Non-limiting examples of sensors that may be communicably coupled with the controller 46 include a temperature sensor and turbidity sensor to determine the soil load associated with a selected grouping of dishes, such as the dishes associated with a particular area of the treating chamber 16.

Figure 3:
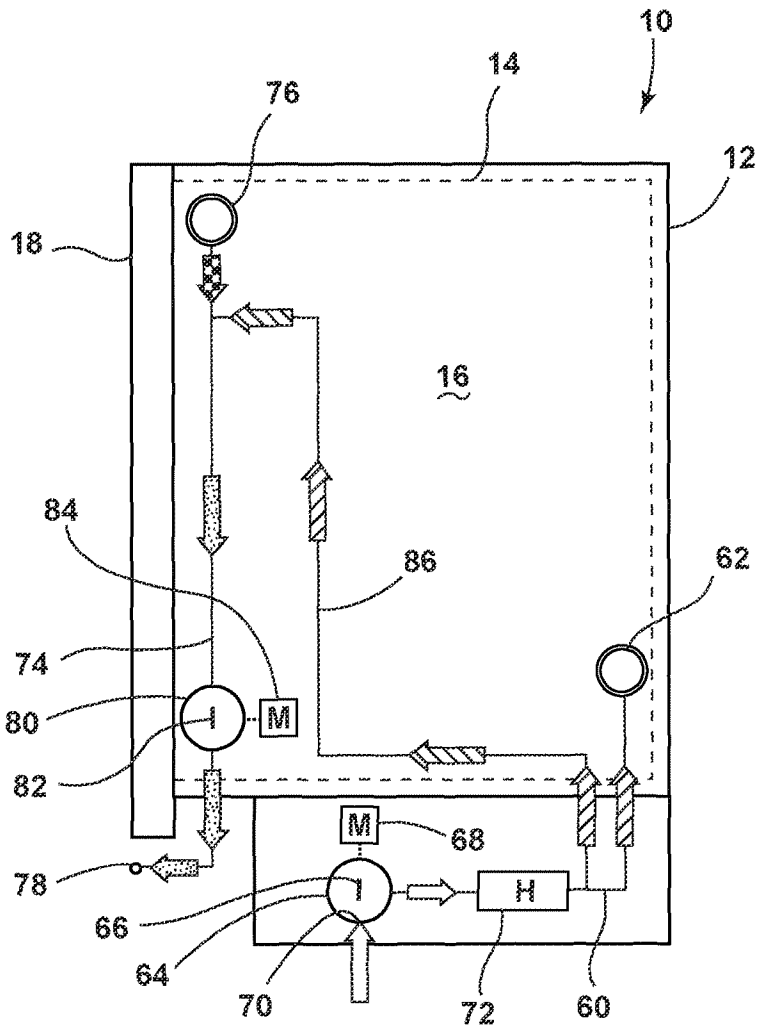
FIG. 3 is a schematic side view of the dishwasher of FIG. 1 illustrating an air system according to one embodiment.

Referring now to FIG. 3, the dishwasher 10 may further include an air system to facilitate drying the dishes, such as at the end of cycle of operation. An air supply system of the air system may provide ambient air to the treating chamber 16, where the ambient air mixes with humid air to form mixed air, and an air exhaust system may exhaust the mixed air from the treating chamber 16. Additionally, ambient air from the air supply system may bypass the treating chamber 16 and combine with the mixed air in the air exhaust system prior to being exhausted from the dishwasher 10. An airflow conduit may facilitate the flow of air through the air supply system, the air exhaust system, and the bypass connecting the air supply system to the air exhaust system. Further, a blower assembly including an impeller for the air supply system and an impeller for the air exhaust system effects airflow through the airflow conduit. Several exemplary embodiments of the air system will now be described with the understanding that features from the individual embodiments may be combined with other embodiments as desired.

Still referring to FIG. 3, the airflow conduit may include an inlet section 60 fluidly coupling ambient air to the treating chamber 16 through a tub inlet 62 formed in the tub 14. Positioned within the inlet section 60 may be a supply blower 64 having a supply impeller 66 driven by a supply motor 68 or other suitable device. The supply impeller 66 may be any suitable type of impeller, including a centrifugal impeller, an axial impeller or fan, and the like. The supply blower 64 may include an inlet 70 open to ambient air, such as by being exposed to atmosphere external to the dishwasher 10, which may form an inlet for the inlet section 60 of the airflow conduit. Optionally, the inlet section 60 may further include a heater 72 located downstream of the supply blower 64 for heating the ambient air drawn into the inlet section 60 by the supply impeller 66 before the ambient air enters the treating chamber 16 through the tub inlet 62. The heater 72 may be any suitable type of heater, such as a resistive heater, and may alternatively be located upstream of the supply blower 64, if desired. The ambient air from the inlet section 60 of the airflow conduit flows into the treating chamber 16 and mixes with the humid air in the treating chamber 16 to form mixed air. Introducing the preheated ambient air that has a higher temperature and lower humidity than the air in the treating chamber 16 enhances evaporation and improves drying performance.

The airflow conduit may further include an outlet section 74 fluidly coupling the treating chamber 16 with ambient air. The outlet section 74 may connect to the treating chamber 16 at a tub outlet 76 formed in the tub 14 and may terminate at an exhaust outlet 78 open to ambient air, such as by being exposed to atmosphere external to the dishwasher 10. An exhaust blower 80 with an exhaust impeller 82 driven by an exhaust motor 84, or other suitable device, positioned within the outlet section 74 may draw the mixed air from the treating chamber 16 through the tub outlet 76, move the mixed air through the outlet section 74, and exhaust the mixed air from the dishwasher 10 through the exhaust outlet 78. The exhaust impeller 82 may be any suitable type of impeller, including a centrifugal impeller, an axial impeller or fan, and the like.

The tub outlet 76 may be positioned higher than the tub inlet 62. For example, the tub inlet 62 may be located near a lower end of the tub 14, while the tub outlet 76 may be located near an upper end of the tub 14. After the ambient air flows into the treating chamber 16, the air flows upward from the tub inlet 62 while it mixes with the humid air inside the treating chamber before being drawn through the tub outlet 76 by the rotating exhaust impeller 82. Locating the tub inlet 62 and the tub outlet 76 in this manner generates a desired drying airflow within the treating chamber 16 to facilitate drying the dishes.

The blower assembly comprising the supply and exhaust impellers 66, 82 and the heater 72, if present, may operably communicate with the controller 46 (FIG. 2) during operation of the air system while drying dishes in the treating chamber 16.

A bypass section 86 of the airflow conduit may fluidly couple the inlet section 60 and the outlet section 74 without passing through the tub 14 (i.e., bypassing the tub 14). In the illustrated embodiment, the bypass section 86 joins the inlet section 60 downstream of the heater 72 so that a portion of the preheated ambient air from the inlet section 60 may flow through the bypass section 86 and enter the outlet section 74 where the preheated ambient air combines with the mixed air to form combined air that is released through the exhaust outlet 78. The ambient air may be sucked through the bypass section 86 by the exhaust blower 80, pushed through the bypass section 86 by the supply blower 64, or a combination thereof, as will be discussed in more detail below. Combining the ambient air with the mixed air, which is more humid than the ambient air, reduces the absolute humidity of the air in the outlet section 74, thus reducing the risk of the moisture in the air condensing on the outlet section 74 itself and on surrounding surfaces, including the surfaces surrounding the dishwasher near the exhaust outlet 78. Additionally, reducing the humidity of the air prior to exhaust also avoids the undesirable situation of the user observing humid air, which the user may improperly assume is steam, leaving the dishwasher. Optionally, the bypass section 86 may join with the outlet section 74 near the tub outlet 76, such as adjacent to the tub outlet 76, so that the humidity of the air in the outlet section 74 is reduced as early as possible in the outlet section 74. Furthermore, the bypass section 86 may join with the outlet section 74 upstream of the exhaust blower 80 to reduce the humidity of the air before the air passes through the exhaust blower 80, thus reducing the risk of the moisture in the air condensing on the exhaust blower 80.

The airflow sections 60, 74, 86, the blower assembly 64, 80, and the heater 72 may be arranged in configurations other than that illustrated in FIG. 3. For example, in an alternative embodiment of the dishwasher 10 in FIG. 4, the bypass section 86 joins the inlet section 60 upstream of the heater 72 such that the ambient air that combines with the mixed air in the outlet section 74 is not heated. Further, the bypass section 86 in the FIG. 4 embodiment is positioned downstream of the exhaust blower 80, which is located adjacent the tub outlet 76.

Figure 4:
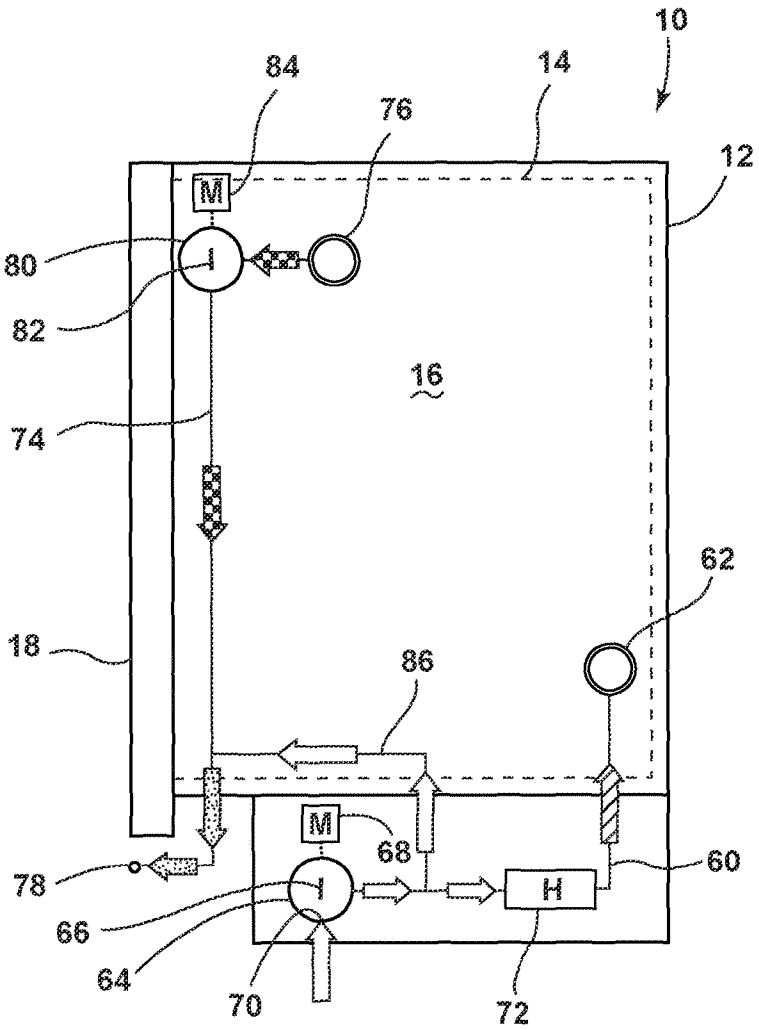
FIG. 4 is a schematic side view of the dishwasher of FIG. 1 with an air system according to another embodiment.

In the embodiments of FIGS. 3 and 4, the blower assembly includes the supply blower 64 and the exhaust blower 80, each having a dedicated motor 68, 84 to drive the respective impeller 66, 82. Alternatively, as illustrated schematically in FIG. 5, the blower assembly may comprise a dual blower 90 having a single blower motor 92 that drives a dual impeller comprising the supply impeller 66 and the exhaust impeller 82. The supply impeller 66 and the exhaust impeller 82, therefore, form opposite sides of the dual impeller. A housing encasing the dual impeller may form a supply chamber 94 that surrounds the supply impeller 66 and an exhaust chamber 96 that surrounds the exhaust impeller 82. The supply and exhaust chambers 94, 96 may form part of the inlet and outlet sections 60, 74, respectively, of the airflow conduit. Structural details of embodiments of the dual blower 90 will be described in more detail below.

As the blower motor 92 drives the dual impeller 66, 82, the supply impeller 66 draws ambient air through the inlet 70 and moves the ambient air through the inlet section 60, including the supply chamber 94, and into the treating chamber 16 through the tub inlet 62 after the ambient air is heated by the heater 72. Simultaneously, the exhaust impeller 82 draws the mixed air from the treating chamber 16 via the tub outlet 76 and moves the mixed air through the outlet section 74, including the exhaust chamber 96, for exhausting through the exhaust outlet 78. Moreover, the supply impeller 66 and/or the exhaust impeller 82 force the heated ambient air through the bypass section 86 to combine the ambient air with the mixed air prior to exhaustion from the dishwasher 10.

Figure 5:
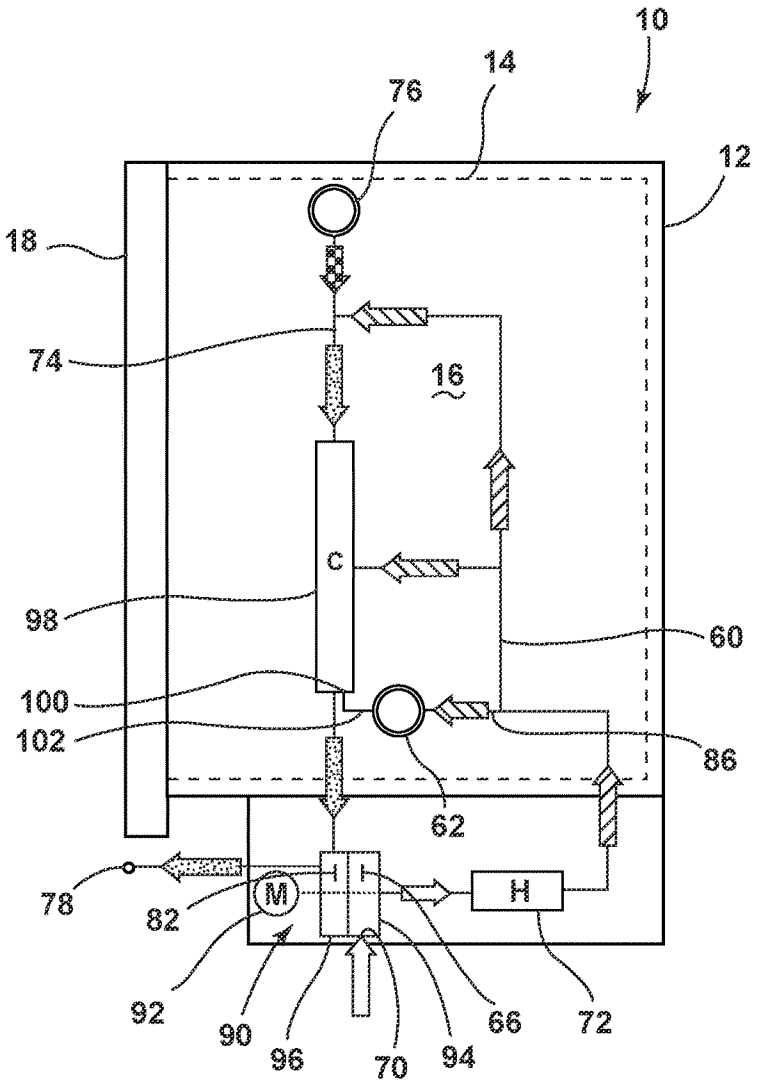
FIG. 5 is a schematic side view of the dishwasher of FIG. 1 with an air system according to another embodiment.

In the embodiment of FIG. 5, the mixed air passes through a condenser 98 in the outlet section 74 to remove at least some of the moisture from the mixed air. The ambient air may combine with the mixed air upstream of the condenser 98, as illustrated, or downstream. As illustrated, the inlet section 60 is fluidly coupled to the condenser 98, directing ambient air into the condenser 98, at one or more locations. Ambient air may enter the condenser 98 at one or more locations along the condenser 98, such as at the top, middle, or bottom of the condenser 98. Within the condenser 98, ambient air is combined with mixed air, after the mixed air provided from the tub outlet 76 has entered the condenser 98. The mixed air will have reduced humidity, drawn by the condenser 98, before it is mixed with ambient air.

Additionally, a liquid outlet 100 of the condenser 98 may fluidly couple with the inlet section 60 in a manner that condensed liquid may flow through the liquid outlet 100 to the tub inlet 62 for draining of the liquid from the condenser 98. The liquid outlet 100 may be connected to the tub inlet 62 by a drain conduit 102, as illustrated, or simply by the liquid outlet 100 opening into the inlet section 60, as will be shown in another embodiment below. Fluidly connecting the condenser 98 to the tub inlet 62 of the inlet section 60 provides a convenient location to drain the condensed liquid without requiring an additional hole in the tub 14.

As understood in FIG. 5, elements comprising the inlet section 60, bypass section 86, tub inlet 62, outlet section 74, tub outlet 76, condenser 98, liquid outlet 100, and drain conduit 102 may be implemented in multiple alternative embodiments, combining ambient air with mixed air upstream, downstream, or within the condenser 98, as well as directing ambient air into the tub 14 through the tub inlet 62. It will be understood that implementation of these elements may be combined in a variety of ways, and that some implementations or elements may be optional or alternate.

Figure 6:
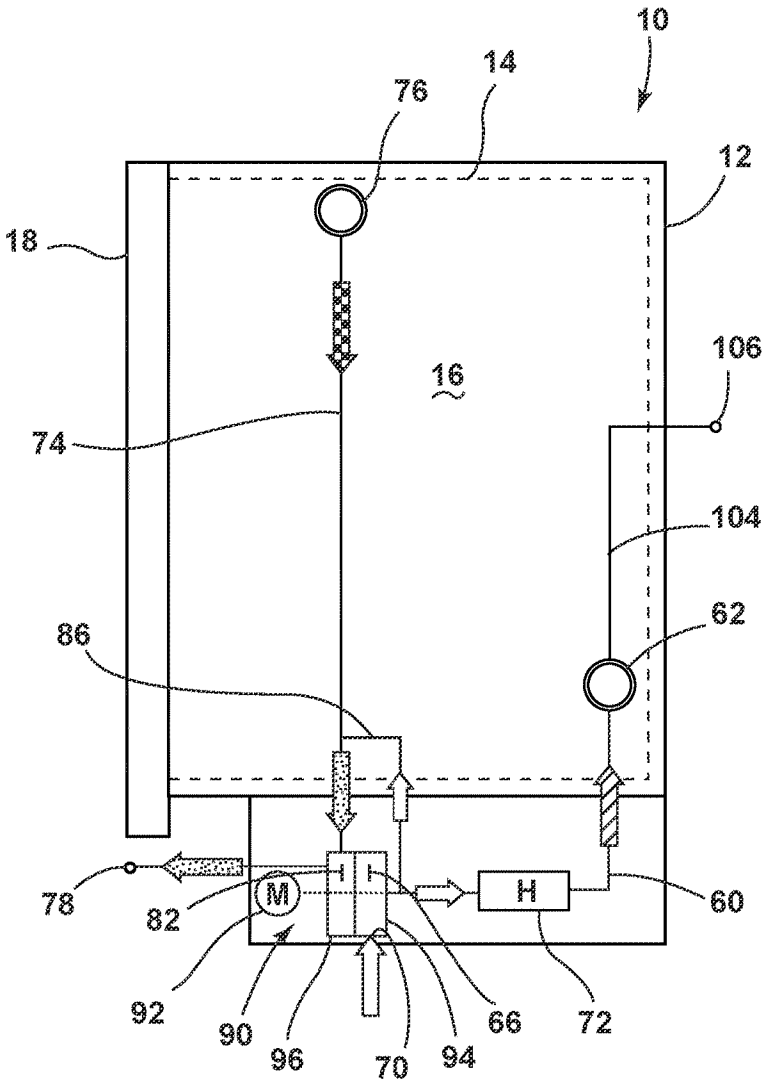
FIG. 6 is a schematic side view of the dishwasher of FIG. 1 with an air system according to another embodiment.

Referring now to FIG. 6, another alternative embodiment of the dishwasher 10 includes the blower system comprising the dual blower 90 but differs from the embodiment of FIG. 5 in that the bypass section 86 couples with the inlet section 60 upstream of the heater 72, such that the ambient air fed into the outlet section 74 is not heated, and couples with the outlet section 74 adjacent to the dual blower 90 rather than adjacent the tub outlet 76. Additionally, a liquid supply conduit 104 may fluidly couple a liquid supply 106, such as an external household water supply, with the inlet section 60. The liquid may flow from the liquid supply 106 and through the liquid supply conduit 104 to the inlet section 60 for entry into the treating chamber 16 through the tub inlet 62. Such an arrangement advantageously utilizes the tub inlet 62 for supplying liquid into the treating chamber 16 and removes a need for an additional hole in the tub 14.

Figure 7:
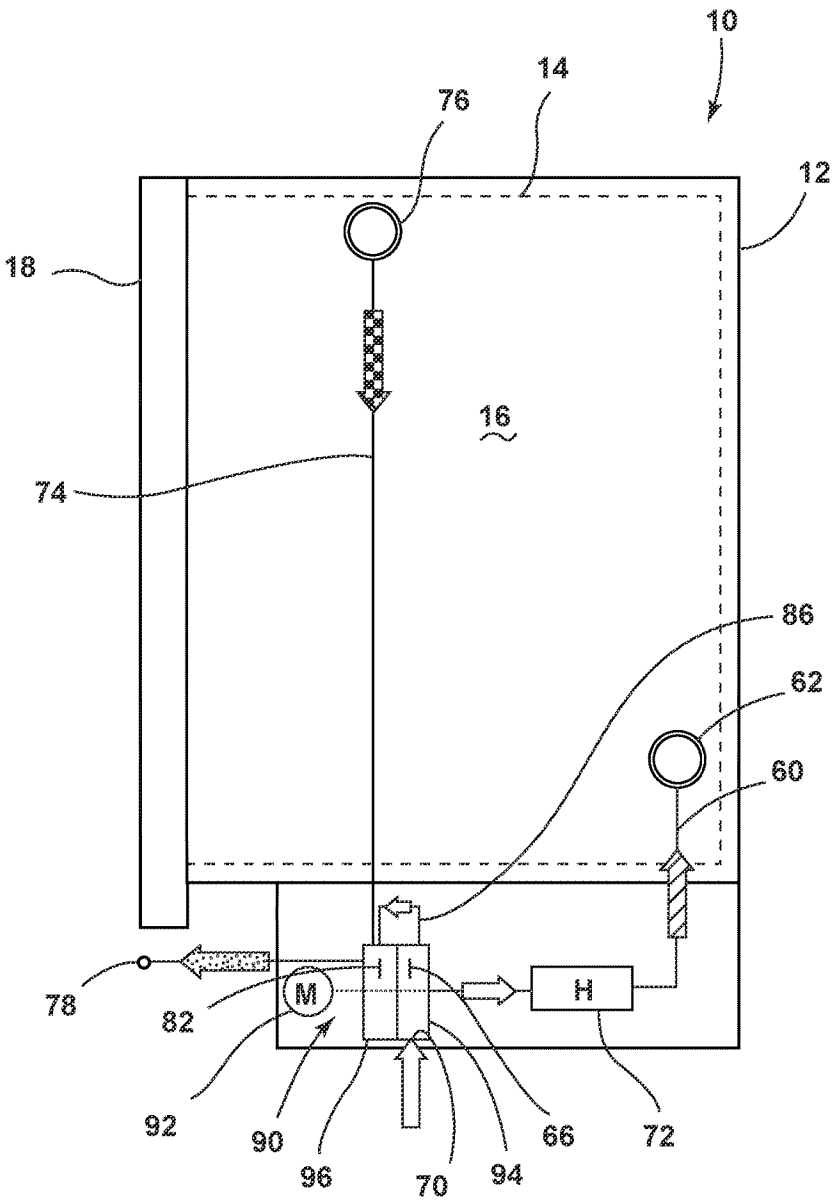
FIG. 7 is a schematic side view of the dishwasher of FIG. 1 with an air system according to another embodiment.

In another exemplary embodiment, illustrated in FIG. 7, the bypass section 86 is shown as connecting the supply chamber 94 with the exhaust chamber 96 such that the combining of the ambient air with the mixed air occurs within the dual blower 90, particularly within the exhaust chamber 96. The bypass section 86 may be formed by a conduit external to the dual blower 90 or within the dual blower 90, such as by an opening in a wall that separates the supply and exhaust chambers 94, 96.

As mentioned above, elements and features from the different exemplary embodiments of FIGS. 3-7 may be combined or altered as desired, as well as including other elements not shown or described. For example, any of the embodiments may include or omit the condenser 98 and/or the connection of the liquid supply conduit 104 to the inlet section 60. The blower system may comprise the separate blowers 64, 80 or the dual blower 90 as desired. Further, the bypass section 86 may connect to the inlet and outlet sections 60, 74 of the airflow conduit in any desired locations and may be connected upstream or downstream of elements located within the airflow conduit, including, but not limited to, the heater 72 and the condenser 98. The bypass section 86 may include more than one airflow path, such as one formed by a conduit connected to the inlet section 60 downstream of the heater (FIG. 5) and one formed by an internal opening between the supply and exhaust chambers 94, 96 (FIG. 7).

The sections 60, 74, 86 of the airflow conduit are formed by conduits and other elements through which air flows to fluidly couple ambient air to the treating chamber 16 (i.e., inlet section 60), the treating chamber 16 to ambient air (i.e., the outlet section 74), and the inlet section 60 to the outlet section 74 (i.e., the bypass section 86). Thus, the chambers holding the impellers 66, 82, the heater 72, the condenser 98, and the tub inlet 62 and outlet 76 all form part of their respective sections of the airflow conduit.

Figure 8:
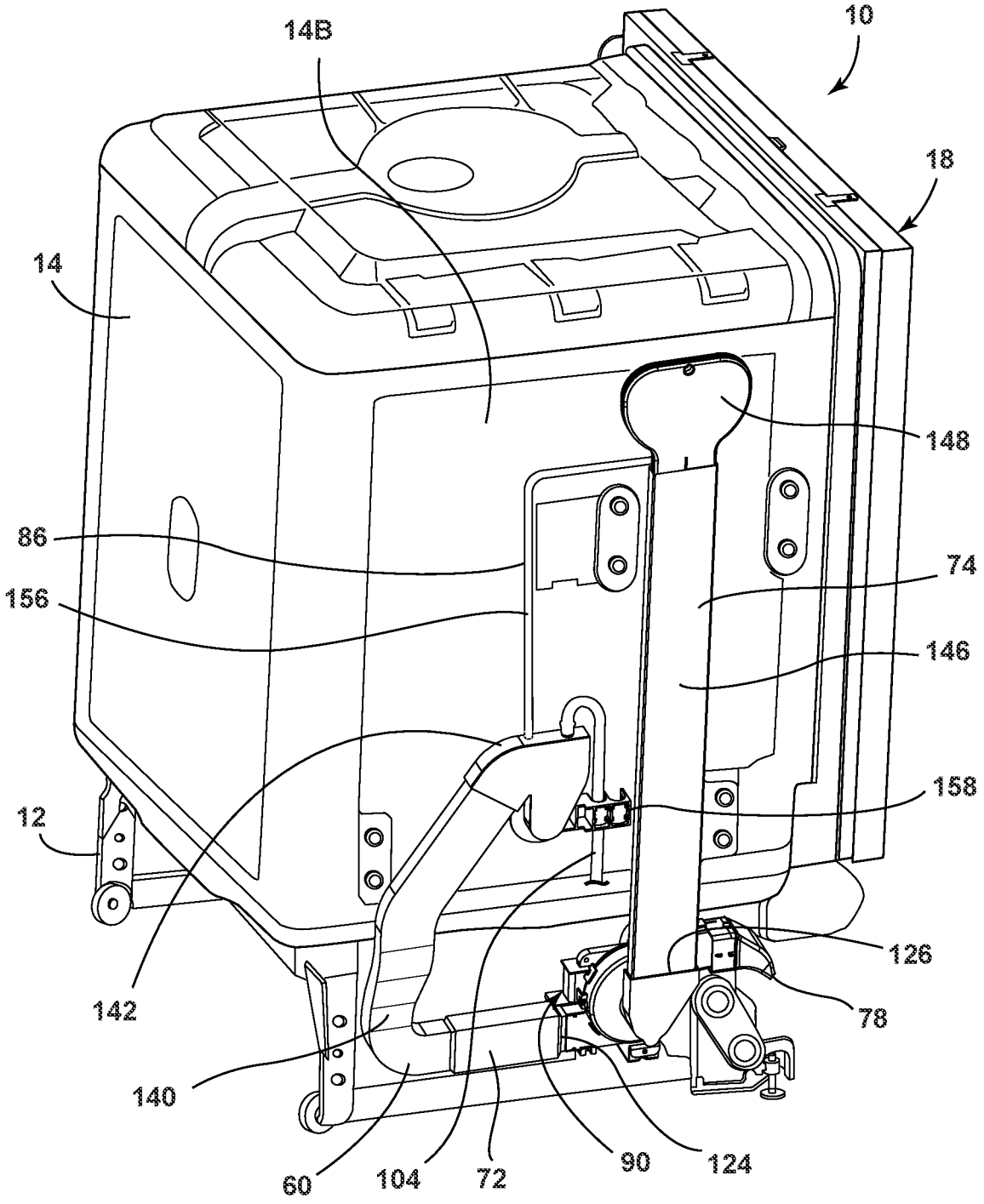
FIG. 8 is a rear perspective view of an exemplary dishwasher with an air system according to another embodiment.

The air system may be configured for placement in locations of the dishwasher 10 exterior of the door assembly 18, which advantageously allows for the door assembly 18 to have a smaller depth (i.e., a thinner door) that projects into the treating chamber 16 a smaller distance, relative to an air system with components located in the door assembly 18, when the door assembly 18 closes the tub 14, thereby effectively creating a larger treating chamber 16. For example, the air system may be located adjacent to one or more of the tub walls 14A, 14B, 14C, 14D, and the exhaust outlet 78 may be positioned below the door assembly 18 directing exhausted air forward of the dishwasher 10. FIG. 8 illustrates an embodiment of an air system with this type of placement.

As seen in FIG. 8, the air system is located on one of the side walls 14B of the tub 14, with some of the air system components, such as the dual blower 90, located in a region below the tub 14. The dual blower 90 is shown in an enlarged view in FIG. 9. The dual blower 90 of the present exemplary embodiment includes a housing 110 for the dual impeller comprising the supply impeller 66 and the exhaust impeller 82 (not shown in FIG. 9) and the dual blower motor 92 mounted to the housing 110 by a support bracket 112. As better seen in the exploded view of FIG. 10, the housing 110 may be formed by a supply housing 114 and an exhaust housing 116 joined together by a partition 118 with mechanical coupling elements 120, such as detents and notches. The partition 118 divides the interior of the housing 110 into the supply chamber 94 on the side of the supply housing 114 and the exhaust chamber 96 on the side of the exhaust housing 116. The supply housing 114 may include an inlet opening 122 that forms the blower inlet 70 and an outlet opening 124 for the supply chamber 94, while the exhaust housing 116 may include an inlet opening 126 and an outlet opening 128 for the exhaust chamber 96. Further, the partition 118 may include a central opening 130 that receives the dual impeller with the supply impeller 66 located in the supply chamber 94 and the exhaust impeller 82 located in the exhaust chamber 96. As an example, the dual impeller may be a centrifugal impeller having forward facing blades 132 for the supply impeller 66 and forward facing blades 134 for the exhaust impeller 82. Other types of impeller blades are contemplated, including rearward facing blades on one or both sides of the dual impeller.

Figure 9:
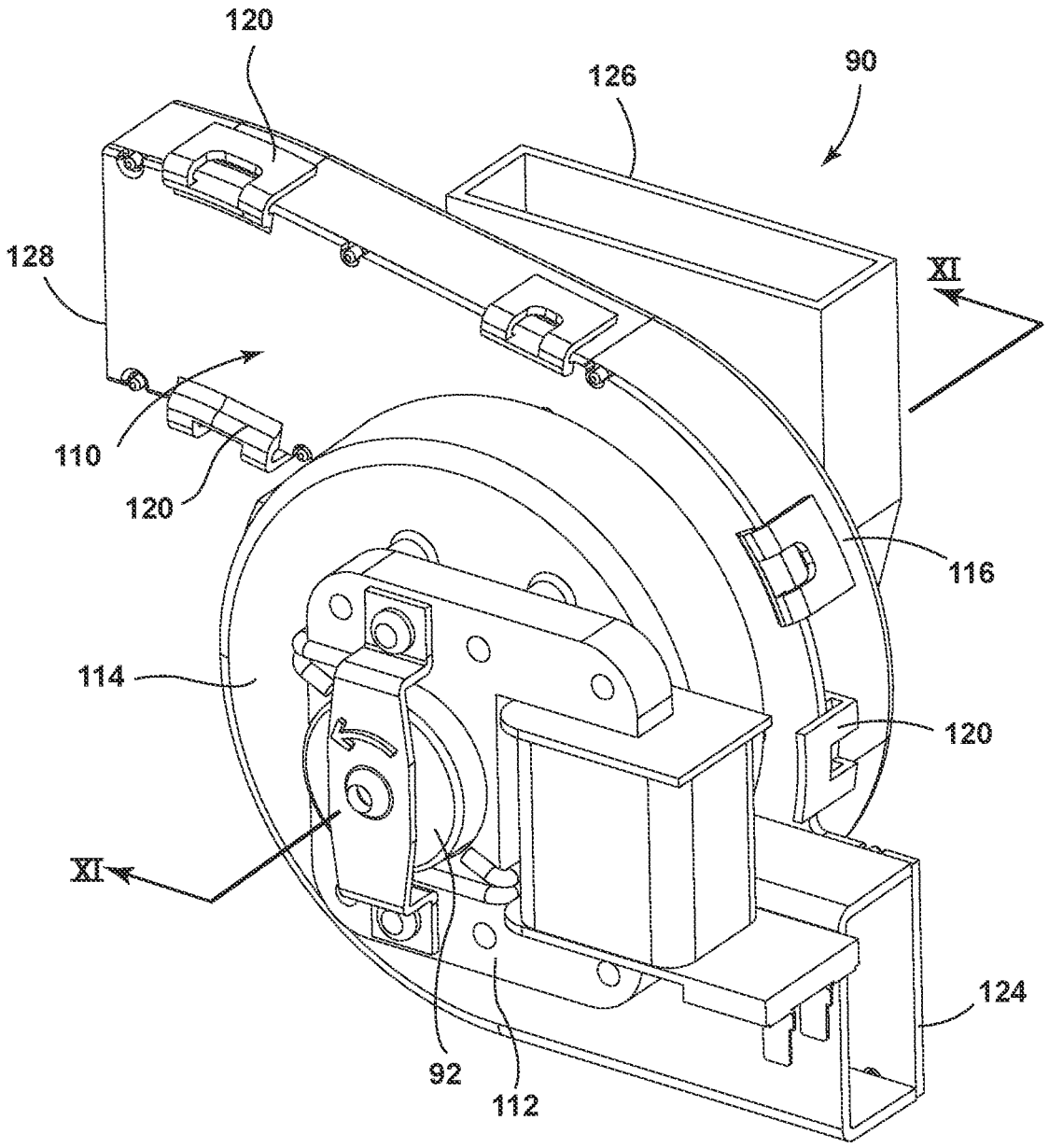
FIG. 9 is a perspective view of a dual blower from the air system of FIG. 8.
Figure 10:
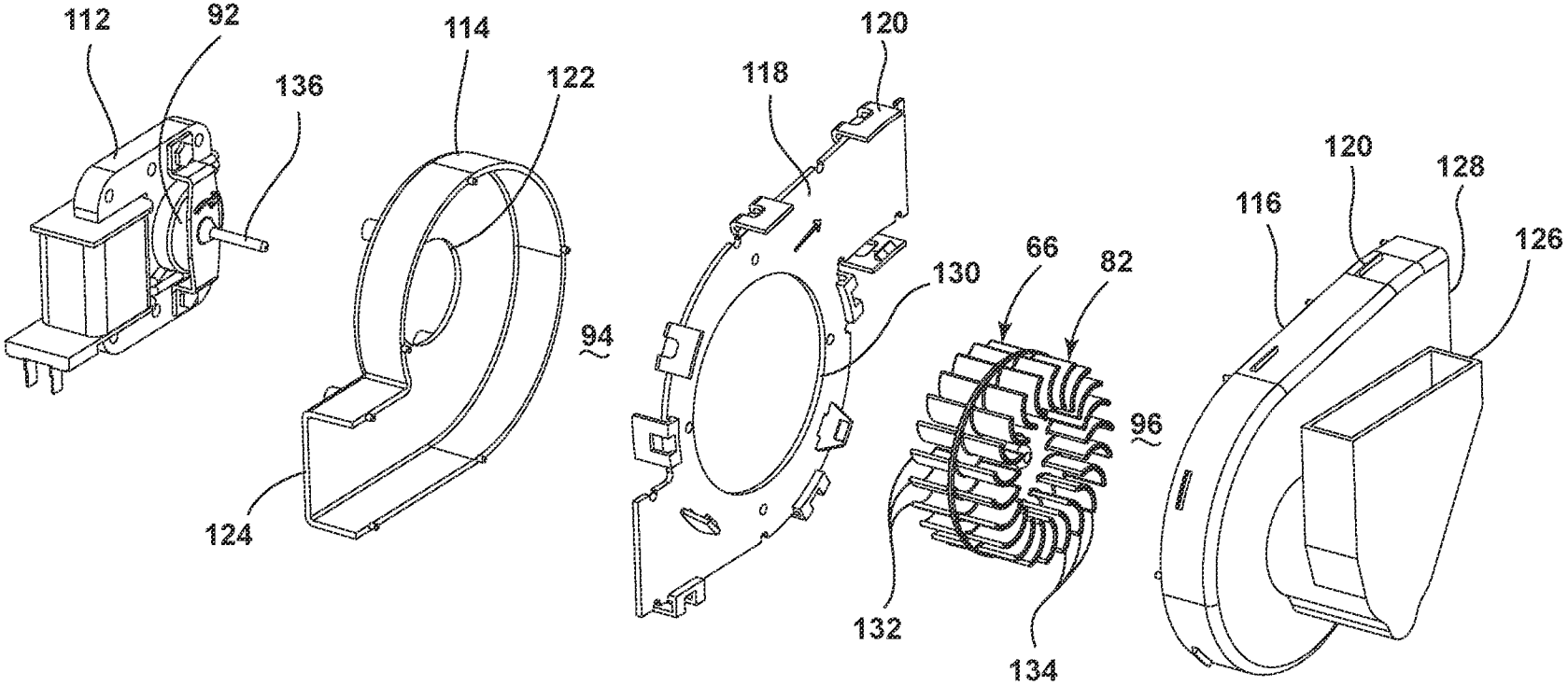
FIG. 10 is an exploded view of the dual blower from FIG. 9.
Figure 11:
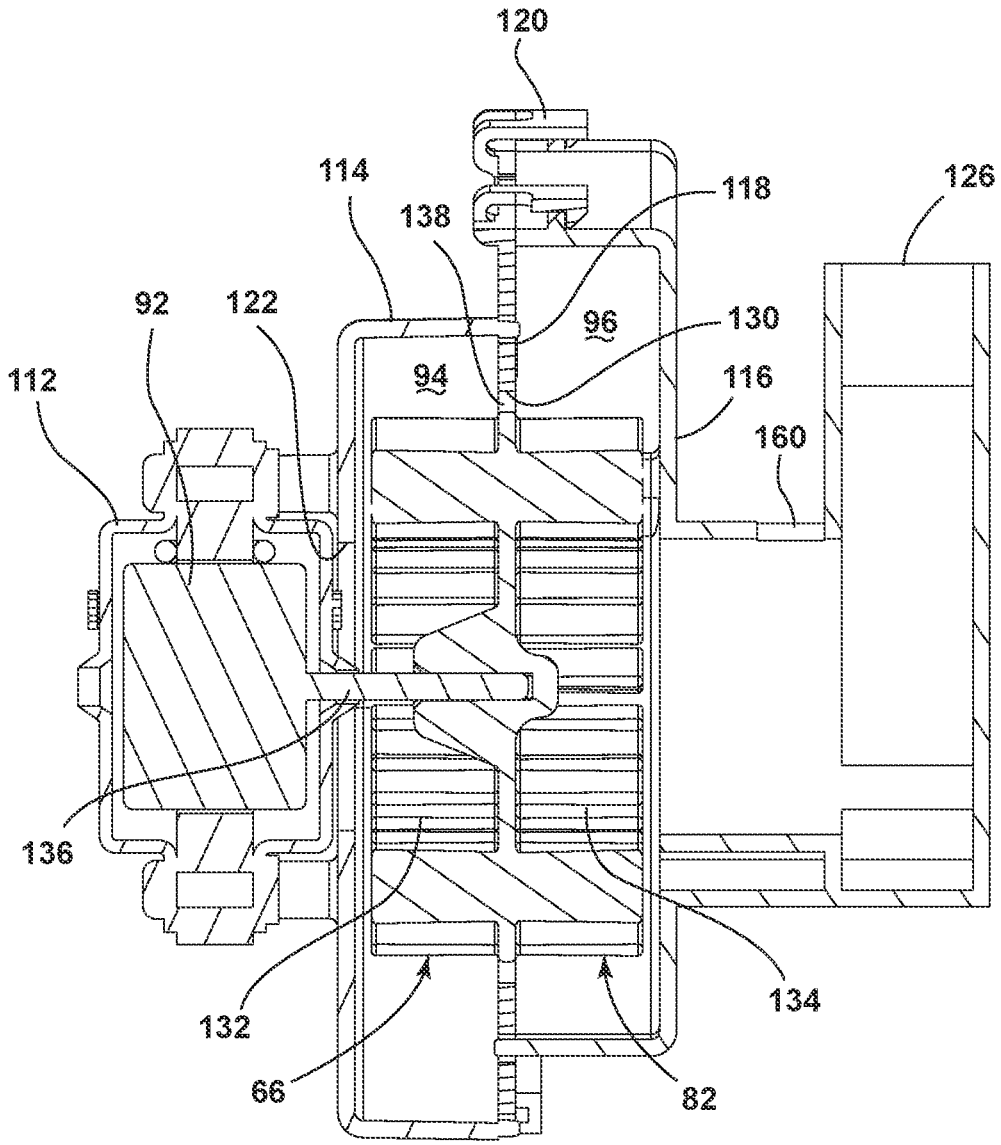
FIG. 11 is a sectional view taken along line XI-XI of FIG. 9.

Referring now to the sectional view of the dual blower 90 in FIG. 11, the dual blower motor 92 may include a motor shaft 136 extending into the housing 110 through the supply chamber inlet opening 122 and operatively coupled to the dual impeller such that rotation of the motor shaft 136 simultaneously rotates the supply impeller 66 and the exhaust impeller 82. Rotation of the impellers 66, 82 generates airflow within the respective chambers 94, 96. In particular, rotation of the supply impeller 66 draws in ambient air through the inlet opening 122 and pushes the air through the outlet opening 124 (FIG. 9), and rotation of the exhaust impeller 82 draws in air through the inlet opening 126 and pushes the air through the outlet opening 128 (FIG. 9).

Optionally, the partition central opening 130 may be sized to provide a space between the outer circumference of the dual blower and the partition 118, and the space may form an internal bypass opening 138 between the supply chamber 94 and the exhaust chamber 96. Some of the ambient air within the supply chamber 94 may flow through the internal bypass opening 138 to the exhaust chamber 96 to combine with the air in the exhaust chamber 96 prior to exhaustion, as described previously with respect to the embodiment shown schematically in FIG. 7, in which case, the internal bypass opening 138 may be considered part of the airflow conduit bypass section 86.

Figure 12:
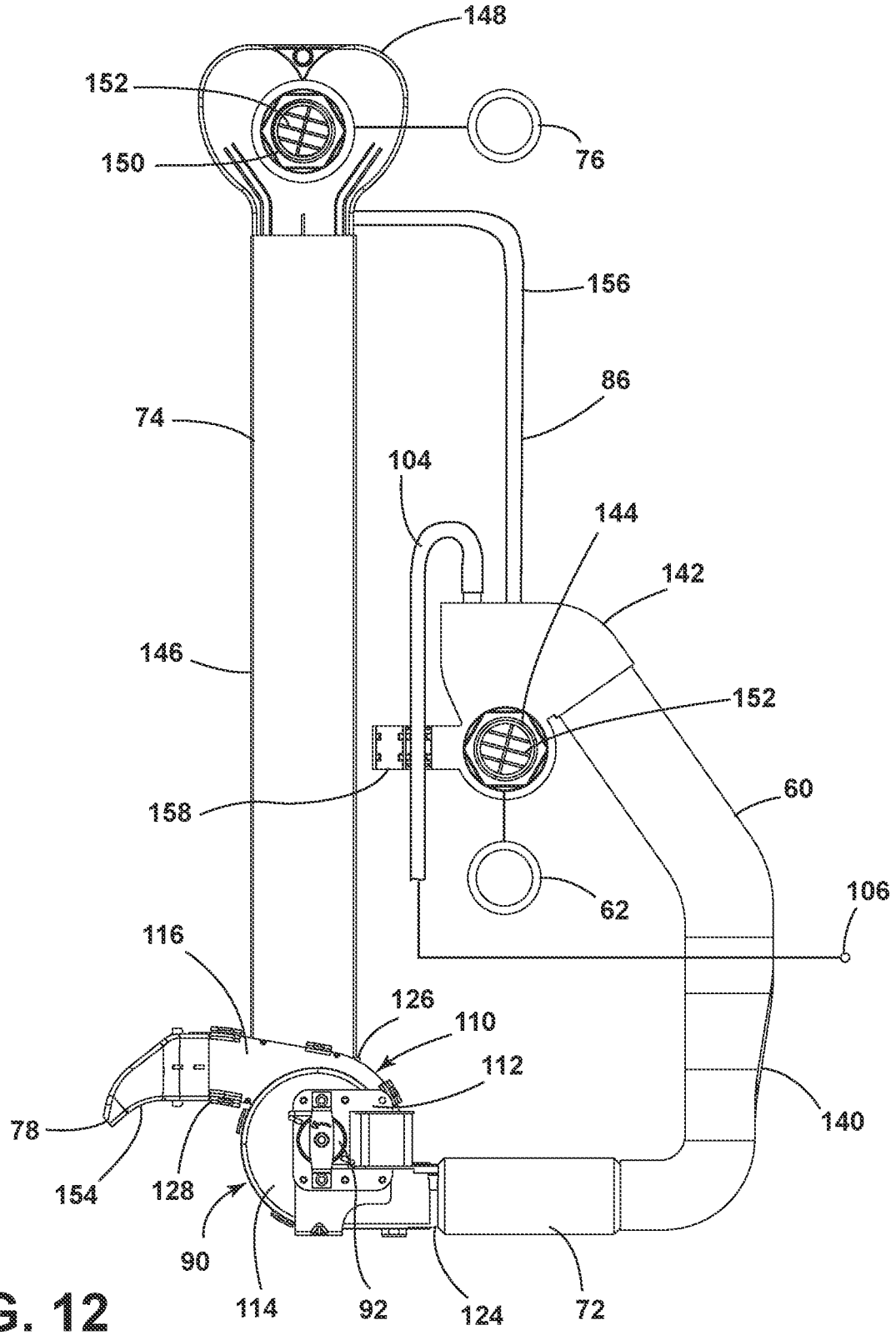
FIG. 12 is a side view of the air system of FIG. 8.

The dual blower 90 may be coupled to conduits and other components forming the airflow conduit of the air system. FIG. 12 provides a view of the side of the air system facing the dishwasher 10 and more clearly illustrates the components of the air system. For example, the supply chamber outlet opening 124 may be coupled to the heater 72 and an inlet conduit 140 connecting the heater 72 to a tub inlet housing 142 having an opening 144 coupled to the tub inlet 62. Similarly, the exhaust chamber inlet opening 126 may be mounted to an outlet conduit 146 connected to a tub outlet housing 148 having an opening 150 coupled to the tub outlet 76. The openings 144, 150 may include louvers 152, optionally, to force the airflow in a desired direction. Additionally, the exhaust chamber outlet opening 128 may be coupled to an exhaust conduit 154 that directs the air to the exhaust outlet 78 formed at the end of the exhaust conduit 154.

The bypass section 86 of the airflow conduit, which may include the internal bypass opening 138 described above, may include a bypass conduit 156 that connects the tub inlet housing 142 to the tub outlet housing 148. The bypass conduit 156 can be connected to other components of the airflow conduit inlet section 60 and outlet section 74, such as the inlet conduit 140 and the outlet conduit 146, if desired.

In addition, the liquid supply conduit 104 described with respect to the embodiment of FIG. 6 may be connected to the tub inlet housing 142 to fluidly couple the liquid supply 106 to the tub inlet 62. The liquid supply conduit 104 may be positioned as desired and is shown by example as above the tub inlet 62 so that the liquid may flow by gravity from the liquid supply conduit 104 into the tub inlet 62. Optionally, a conduit bracket 158 may be integrally formed with or attached to the tub inlet housing 142 to secure the liquid supply conduit 104 in place. The conduit bracket 158 may be configured to secure other conduits, such as a drain conduit, if desired.

While the operation of the air system shown in FIGS. 8-12 is apparent from the above description of the previous embodiments and the detailed explanation of the dual blower 90, a brief summary follows with combined reference to FIGS. 8-12. Most of the components mentioned below in conjunction with the operation are viewable in FIG. 12; other components, particularly those internal to the dual blower 90, are viewable in FIGS. 10 and 11. Rotation of the supply impeller 66 by the dual blower motor 92 draws ambient air into the inlet section 60 of the airflow conduit through the supply chamber inlet opening 70/122. The ambient air flows through the supply chamber 94 and exits the supply chamber 94 through the outlet opening 124 for entry into the heater 72. The heated air flows from the heater 72 and through the inlet conduit 140 into the tub inlet housing 142, where the heated ambient air enters the tub 14 through the tub inlet 62. The heated ambient air mixes with humid air inside the treating chamber 16 to form mixed air.

Implementing none, or one or more heaters 72 at any point along the blower assembly is contemplated. One or more heaters 72, implemented in the aforementioned embodiments, is optional and may or may not be included within any inlets or outlets, or may be upstream or downstream from any other element as described and is not limiting. In a further embodiment, the heater 44 located within the sump 34 may be used to heat the air within the treating chamber 16 during drying, or air supply and removal. The heater 44 located within the sump 34 may or may not be used in conjunction with another heater 72 implemented at any point along the blower assembly.

Simultaneous rotation of the exhaust impeller 82 by the dual blower motor 92 draws the mixed air from the treating chamber 16 through the tub outlet 76 into the outlet section 74 of the airflow conduit. The mixed air flows from the tub outlet 76 into the tub outlet housing 148 and the outlet conduit 146. Further, the rotation of the supply impeller 66 and/or the exhaust impeller 82 forces some of the heated ambient air in the tub inlet housing 142 to flow through the bypass conduit 156 that forms at least part of the bypass section 86 of the airflow conduit into the tub outlet housing 148 to combine with the mixed air to form combined air. The combined air flows through the outlet conduit 146 and through the exhaust chamber inlet opening 126 into the exhaust chamber 96. Some of the ambient air from the supply chamber 94 may flow through the internal bypass opening 138 to further combine with the combined air prior to the combined air passing through the exhaust chamber outlet opening 128 and through the exhaust conduit 154 to the exhaust outlet 78. The exhaust outlet 78 directs the air forwardly of the dishwasher below the tub 14 and the door assembly 18 (FIG. 8), and the reduction in the humidity of the air due to the mixing and combining of the air from the treating chamber 16 with ambient air, which may be preheated, results in reduced undesired condensation on areas and surfaces surrounding the exhaust outlet 78.

An optional feature that may be included in the dual blower 90 is an external bypass opening 160 shown in FIG. 11. The external bypass opening 160 may be formed in the exhaust housing 116 and may bring ambient air into the exhaust chamber 96. The external bypass opening 160 may be fluidly coupled to the inlet section 60 of the airflow conduit to transport ambient air, preheated or not, into the exhaust chamber 96 to combine with the mixed air from the treating chamber 16. Alternatively, the external bypass opening 160 need not be coupled to the inlet section 60 and may rather be open to the atmosphere in a manner similar to the inlet side of the dual blower 90 so as to bring ambient air into the exhaust chamber 96.

Figure 13:
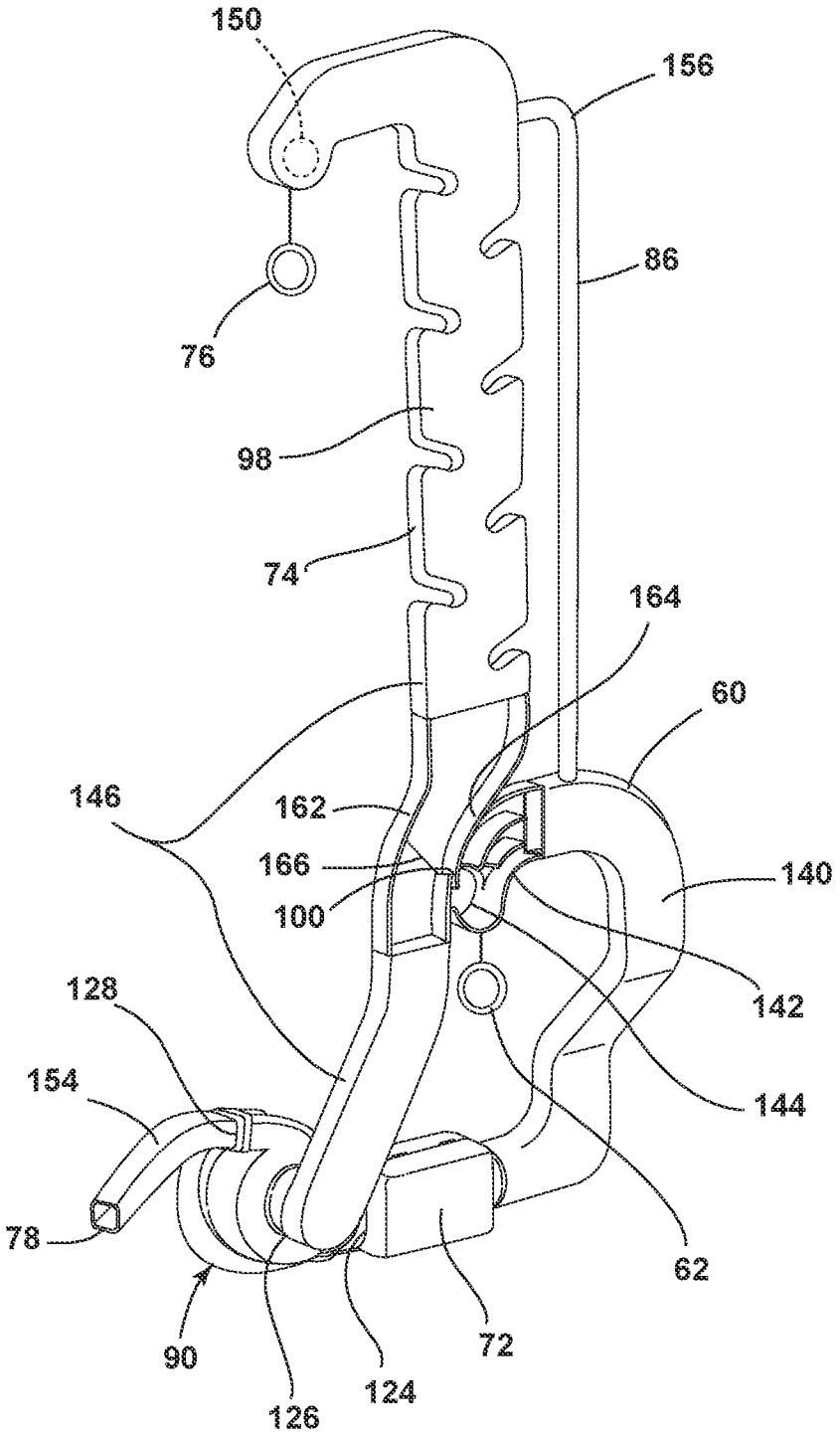
FIG. 13 is a perspective view of an alternative air system.

Another embodiment of the air system is illustrated in FIG. 13. Conceptually, the FIG. 13 embodiment corresponds to the embodiment of FIG. 5 in that it includes the condenser 98 in the outlet section 74 and the liquid outlet 100 of the condenser 98 fluidly coupled to the inlet section 60 for draining into the treating chamber 16. The exemplary condenser 98 in FIG. 13 is formed within the outlet conduit 146 and creates a serpentine airflow path to effect separation of moisture from the mixed air that has combined with the heated ambient air from the bypass conduit 156 upstream of the condenser 98. The outlet conduit 146 may be divided into upper and lower sections, with the condenser 98 located in the upper section, by a drain housing 162 formed integrally with the tub inlet housing 142. The integrated drain housing 162 and tub inlet housing 142 is shown enlarged in FIG. 14. A partition 164 may separate the airflow conduit inlet section 60 from the airflow conduit outlet section 74 within the interior of the combined drain and tub inlet housing 162, 142. The liquid outlet 100 for the condenser 98 may be formed within the partition 164 such that the liquid removed from the air in the condenser 98 may flow downward within the condenser 98 due to gravity and exit the condenser 98 through the liquid outlet 100. Within the drain housing 162, a liquid deflector 166, such as a partial wall extending transversely across the drain housing 162, may direct the liquid towards the liquid outlet 100 and prevent the liquid from flowing to the dual blower 90 (FIG. 13). The liquid flowing through the liquid outlet 100 may enter the drain conduit 102 formed within the combined drain and tub inlet housing 162, 142 fluidly connecting the liquid outlet 100 to the tub inlet 62 such that the condensed liquid may drain into the treating chamber 16 through the tub inlet 62. Additionally, the tub inlet housing 142 may optionally include one or more arcuate vanes 168 that encourage the flow of ambient air towards the tub inlet 62.

The remaining components of the FIG. 13 embodiment are apparent from the description of the previous embodiments and do not warrant further description. The design of the dual blower 90 differs from the embodiment of FIGS. 8-12 in that the dual blower 90 is effectively reversed in orientation with the supply side of the blower 90 facing inward (i.e., towards the dishwasher 10) and the exhaust side of the blower 90 facing outward (i.e., away from the dishwasher 10).

Regardless of the specific configuration of various conduits, housings, heaters, etc. of the air system, the system can be designed with desired air pressure differentials to encourage flow of ambient air through the bypass section 86 from the inlet section 60 to the outlet section 74. In one embodiment, the air pressure in the inlet section 60 at its connection to the bypass section 86 may be higher than the air pressure in the outlet section 74 at its connection the bypass section 86. The ambient air, in this environment, flows "downhill" from higher pressure to lower pressure and, thus, from the inlet section 60 to the outlet section 74 through the bypass section 86. Such a pressure differential can be designed within the system by, for example, configuring the supply impeller 66 to generate a higher pressure airflow than the exhaust impeller 82, such as by altering the impeller blade direction, shape, spacing, size, and the like. Additionally or alternatively, flow restrictions may be designed to achieve a desired air pressure in the inlet section 60 and/or the outlet section 74. Flow restrictions can be adjusted by changing the cross-sectional area of the conduits and housings through which the air flows and the angles at which the air must turn within the conduits and housings. Depending on the air pressure generated by the supply impeller 66 and the exhaust impeller 82 and on the flow restrictions in the system, the air flow through the bypass section 86 may be generated by the supply impeller 66 pushing the air through the bypass section 86, the exhaust impeller 82 sucking the air through the bypass section 86, or a combination thereof.

Figure 15:
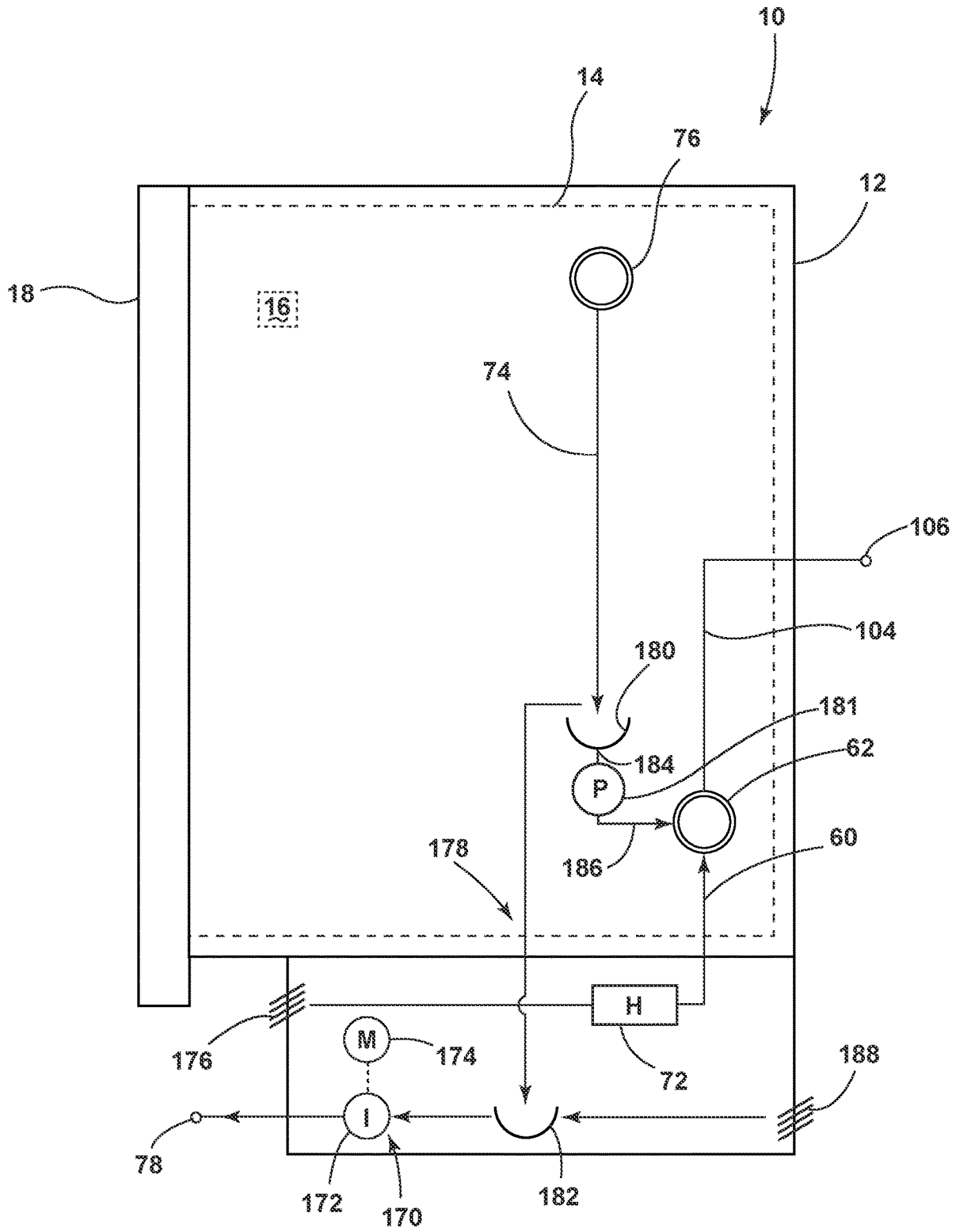
FIG. 15 is a schematic side view of the dishwasher of FIG. 1 with an air system according to another embodiment.

FIG. 15 is a schematic side view of the dishwasher 10 of FIG. 1 with an air system according to another embodiment. An air supply system of the air system may provide ambient air to the treating chamber 16, where the ambient air mixes with humid air to form mixed air, and an air exhaust system may exhaust the mixed air from the treating chamber 16. Additionally, at least some of the moisture from the mixed air in the air exhaust system can be collected prior to being exhausted from the dishwasher 10. An airflow conduit may facilitate the flow of air through the air supply system, the air exhaust system, and the moisture collector.

In FIG. 15, the air system can include a blower assembly 170 having an impeller 172 driven by a motor 174 or other suitable device. The impeller 172 may be any suitable type of impeller, including a centrifugal impeller, an axial impeller or fan, and the like. The blower assembly 170 may operably communicate with the controller 46 (FIG. 2) during operation of the air system while drying dishes in the treating chamber 16. While the blower assembly 170 illustrated includes a single impeller 172, the present embodiment can alternatively be provided with a dual impeller blower assembly similar to the dual impeller blower 90 shown in FIGS. 9-11.

The blower assembly 170 can draw air from the treating chamber 16 through the tub outlet 76 of the outlet section 74. Make-up ambient air is drawn into the treating chamber 16 through a vent 176, with the inlet section 60 fluidly coupling the vent 176 to the treating chamber 16 through the tub inlet 62. The vent 176 can be provided under the door 18, and may also be used for pressure relief, such as when the pump is started after a very hot water fill. The ambient air from the inlet section 60 flows into the treating chamber 16 and mixes with the humid air in the treating chamber 16 to form mixed air. Optionally, heater 72 can be located downstream of the vent 176 for heating the ambient air drawn into the inlet section 60 before the ambient air enters the treating chamber 16 through the tub inlet 62. In a further embodiment, the heater 44 located within the sump 34 (FIG. 1) may be used to heat the air within the treating chamber 16 during drying, or air supply and removal. In an optional embodiment, the dedicated tub inlet 62 may be omitted and/or moved to the door, especially the bottom of the door, with the operation of the fan 170 pulling in ambient air from the door vent, where it mixes with humid air in the chamber 16, and then pulled through the condenser.

Additionally, liquid supply conduit 104 may fluidly couple the liquid supply 106, such as an external household water supply, with the inlet section 60. The liquid may flow from the liquid supply 106 and through the liquid supply conduit 104 to the inlet section 60 for entry into the treating chamber 16 through the tub inlet 62. Such an arrangement advantageously utilizes the tub inlet 62 for supplying liquid into the treating chamber 16 and removes a need for an additional hole in the tub 14. Alternatively, the liquid supply conduit 104 can be coupled with an inlet opening into the tub 14 that is separate from the tub inlet 62.

When the moist mixed air leaves the treating chamber 16 and enters the outlet section 74, the moisture in the air will immediately start to condense because the temperature in the outlet section 74 is lower than in the treating chamber 16. In the embodiment of FIG. 15, the mixed air passes through a collector 178 in the outlet section 74 of the airflow conduit to collect at least some of the moisture condensed from the mixed air. The collector 178 includes a first reservoir 180 associated with the airflow conduit and a second reservoir 182 associated with the airflow conduit downstream of the first reservoir 180. The first reservoir 180 collects liquid condensed from the air forced through the airflow conduit, and is fluidly coupled to the tub 14 for draining the collected liquid into the tub 14. The second reservoir 182 collects liquid condensed from the air prior to the exhaustion of the air to the ambient air. Any liquid not collected by the first reservoir 180 is collected by the second reservoir 182 for evaporation.

Figure 14:
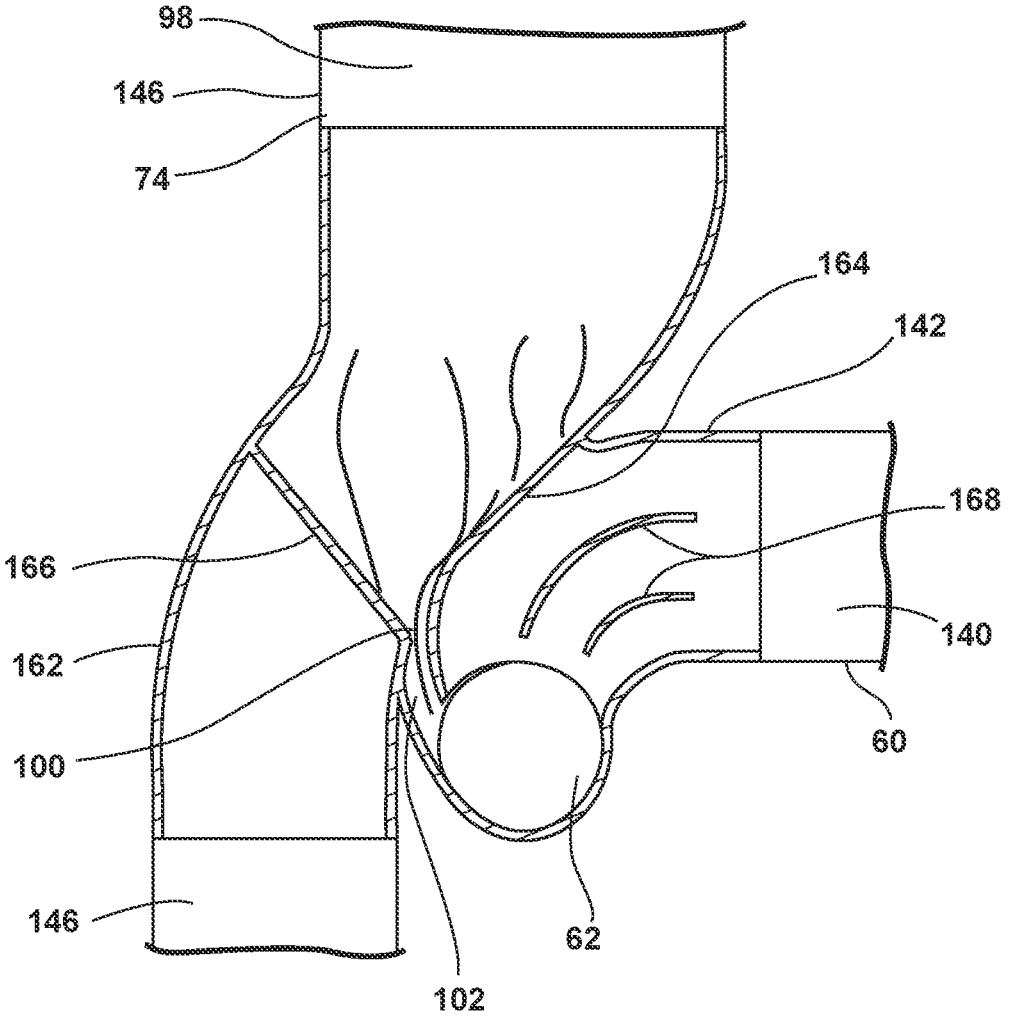
FIG. 14 is an enlarged view of the region labeled XIV of the alternative air system of FIG. 13.

A liquid outlet 184 of the first reservoir 180 may fluidly couple with the inlet section 60 in a manner that condensed liquid within the first reservoir 180 may flow through the liquid outlet 184 to the tub inlet 62 for draining of the liquid from the first reservoir 180. The liquid outlet 184 may be connected to the tub inlet 62 by a drain conduit 186, as illustrated, or simply by the liquid outlet 184 opening into the inlet section 60, as shown in the embodiment of FIG. 14. Fluidly connecting the first reservoir 180 to the tub inlet 62 of the inlet section 60 provides a convenient location to drain the condensed liquid without requiring an additional hole in the tub 14. Alternatively, the first reservoir 180 can be coupled with a drain opening into the tub 14 that is separate from the tub inlet 62.

The first reservoir 180 may be considered an open reservoir as the collected liquid is drained into the tub 14. The second reservoir 182 may be considered a closed reservoir as it is not drained, but rather emptied via evaporation. In the illustrated embodiment the second, closed reservoir 182 is fluidly downstream of the first, open reservoir 180, but in an alternative embodiment, an open reservoir may be located downstream of a closed reservoir. Further, while the collector 178 is shown as having two reservoirs, in other embodiments the collector 178 may include more than two reservoirs, including various combinations of open and closed reservoirs.

The first reservoir 180 may be positioned higher than the second reservoir 182. For example, the first reservoir 180 may be located on a sidewall of the tub 14, between the tub inlet 62 and the tub outlet 76, while the second reservoir 182 may be located in a region below the tub 14. Locating the reservoirs 180, 182 in this manner provides a dual-collection arrangement with enough capacity to prevent liquid from spilling out of the dishwasher 10 or condensation forming an area outside or around the exterior of the dishwasher, such as on the floor or cabinets. Additionally, having the reservoir 180 that is open to drain into the tub 14 higher in the dishwasher 10 allows liquid in the first reservoir 180 to drain under gravity to the tub 14. Alternatively, an embodiment of the collector 178 can include an open reservoir provided lower a closed reservoir in the dishwasher 10, but a pump is needed to drain the collected liquid from the open reservoir.

The first reservoir 180 may be positioned higher than the tub inlet 62. For example, the first reservoir 180 and tub inlet 62 may both be located on a common sidewall of the tub 14, with the first reservoir 180 located above the tub inlet 62. Locating the reservoir 180 and tub inlet 62 in this manner can provide for a gravity-feed drain of liquid from the first reservoir 180 to the tub inlet 62. Alternatively, the first reservoir 180 may be provided lower than the tub inlet 62 in the dishwasher 10, but a pump may be needed to drain the collected liquid from the first reservoir 180 into the tub inlet 62. In yet another alternative embodiment, both reservoirs 180, 182 can be operatively coupled with a pump or separate pumps to actively drain the liquid collected in the reservoirs. Pump 181, as illustrated in FIG. 15, can actively drain the liquid collected in the first reservoir 180.

The blower assembly 170 is fluidly coupled with a second vent 188 and further draws ambient air into the outlet section 72 through the vent 188. The ambient air from the vent 188 is combined with the mixed air before it exits the dishwasher 10 through the exhaust outlet 78 in order to lower the temperature of the air exhausted from the dishwasher 10. The ambient air drawn in through the second vent 188 may also aid in the evaporation of some of the liquid collected in the second reservoir 182, although the liquid collected in the second reservoir 182 may primarily evaporate over time after the conclusion of a cycle of operation, i.e. when the blower assembly 170 is not in operation. In this case, the pathway between the vent 188 and the blower assembly 170 includes the second reservoir 182. In another embodiment, the vent 188 may be coupled with the blower assembly 170 and not the second reservoir 182.

While a bypass section is not shown for the present embodiment, it is understood that the present embodiment can alternatively be provided with a bypass section similar to the bypass section 86 shown in any of the previous embodiments.

Figure 16:
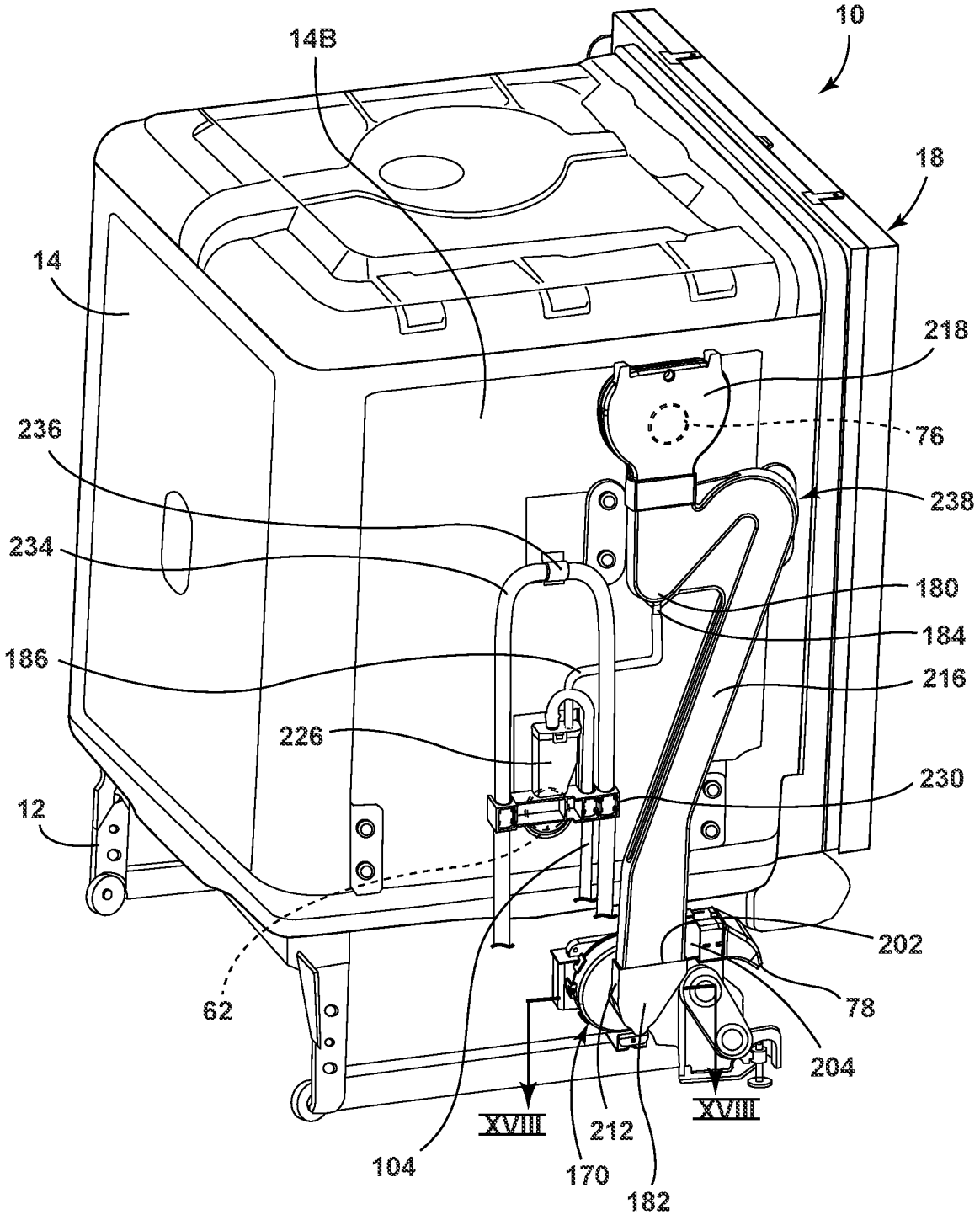
FIG. 16 is a rear perspective view of an exemplary dishwasher with an air system according to another embodiment.
Figure 17:
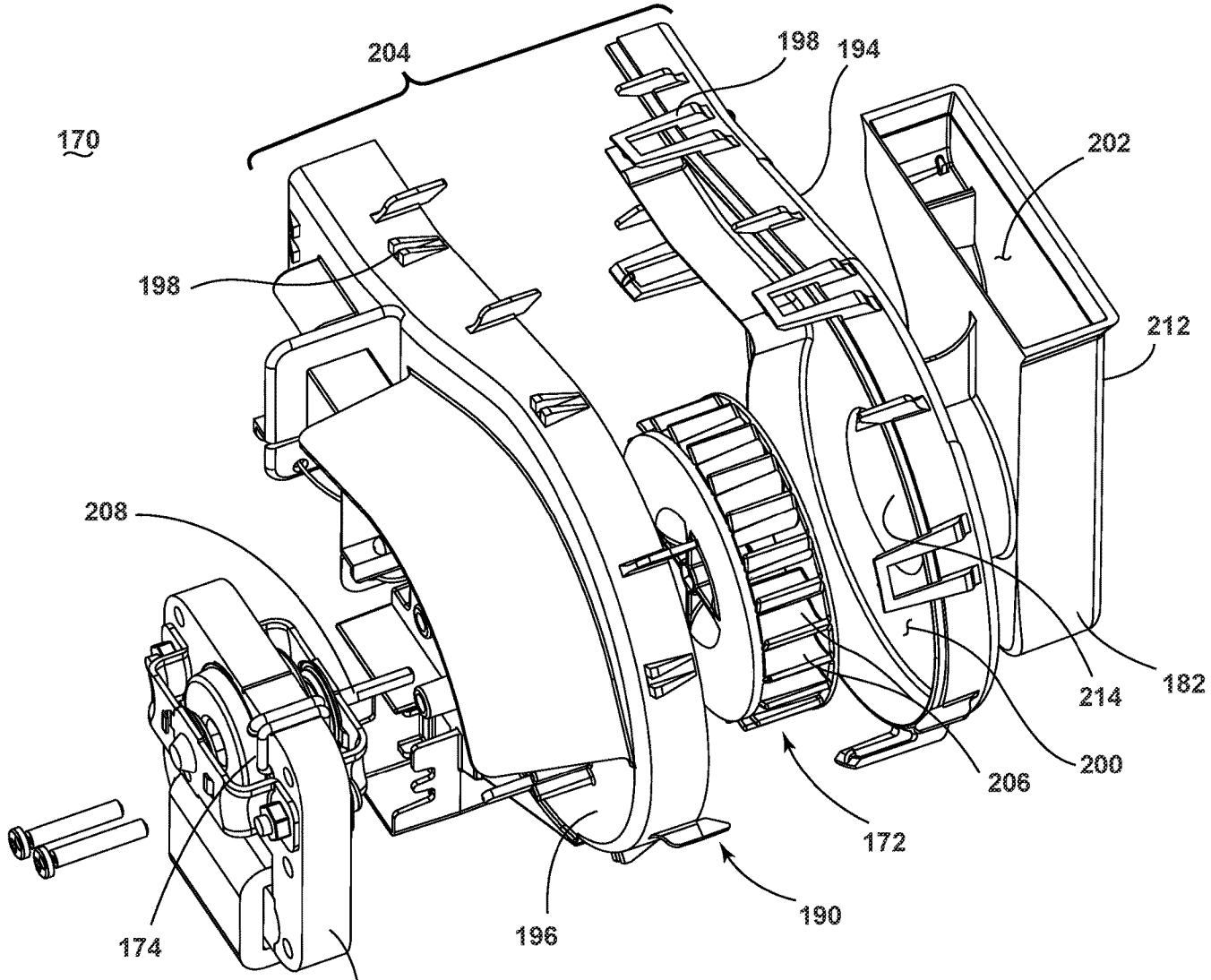
FIG. 17 is an exploded view of a blower from FIG. 16.

FIG. 16 is a rear perspective view of an exemplary dishwasher 10 with an air system according to another embodiment. The air system may be substantially similar to the schematic embodiment shown in FIG. 15. As seen in FIG. 16, the air system is located on one of the side walls 14B of the tub 14, with some of the air system components, such as the blower assembly 170, located in a region below the tub 14. The blower assembly 170 is shown in an exploded view in FIG. 17. The blower assembly 170 of the present exemplary embodiment includes a housing 190 for the impeller 172 which both supplies air to and exhausts air from the tub 14 and a blower motor 174 mounted to the housing 190 by a support bracket 192. The housing 190 may be formed by a first housing 194 and a second housing 196 joined together with mechanical coupling elements 198, such as detents and notches, and defining an impeller chamber 200. The housing 190 may include an inlet opening 202 that forms a blower inlet and an outlet opening 204 that forms a blower outlet. As an example, the impeller 172 may be a centrifugal impeller having a plurality of forward facing blades 206. Other types of impeller blades 206 are contemplated, including rearward facing blades.

The blower motor 174 may include a motor shaft 208 extending into the housing 190 through an opening in the second housing 196, and operatively coupled to the impeller 172 such that rotation of the motor shaft 208 rotates the impeller 172. Rotation of the impeller 172 generates airflow within the impeller chamber 200. In particular, rotation of the impeller 172 draws in air through the inlet opening 202 and pushes the air through the outlet opening 204.

Figure 18:
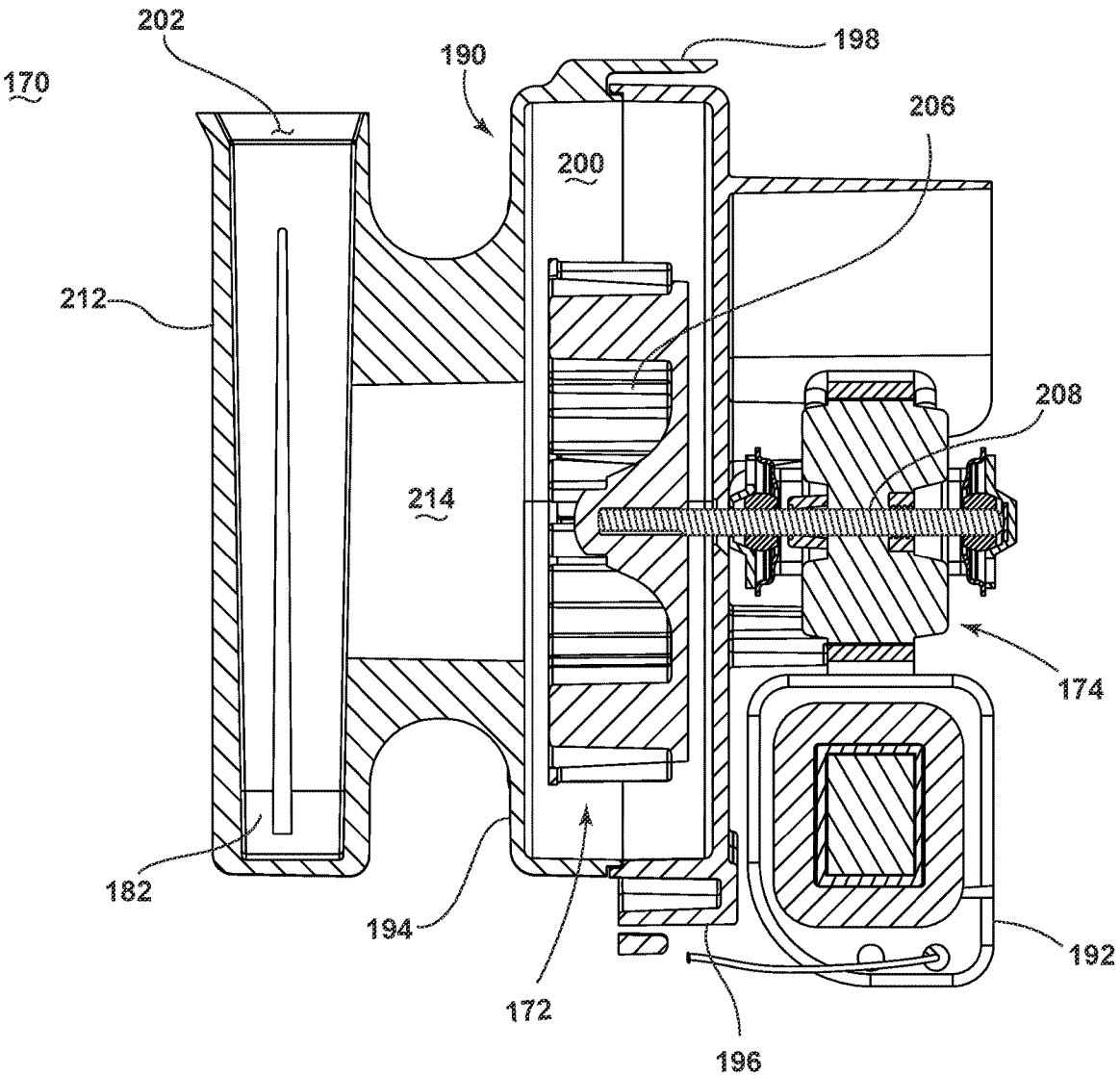
FIG. 18 is a sectional view taken along line XVIII-XVIII of FIG. 16.

FIG. 18 is a sectional view taken along line XVIII-XVIII of FIG. 16. The inlet opening 202 of the blower assembly 170 can be formed by an inlet housing 212 on the first housing 194. A lower portion of the inlet housing 212 can define the second reservoir 182. The first housing 194 can include a central opening 214 leading from the inlet housing 212 to the impeller chamber 200. The second reservoir 182 can be the portion of the inlet housing 212 below the central opening 214. In other embodiments, another portion of the blower assembly 170 may define the second reservoir 182, or the second reservoir 182 may be defined separately from the blower assembly 170.

Figure 19:
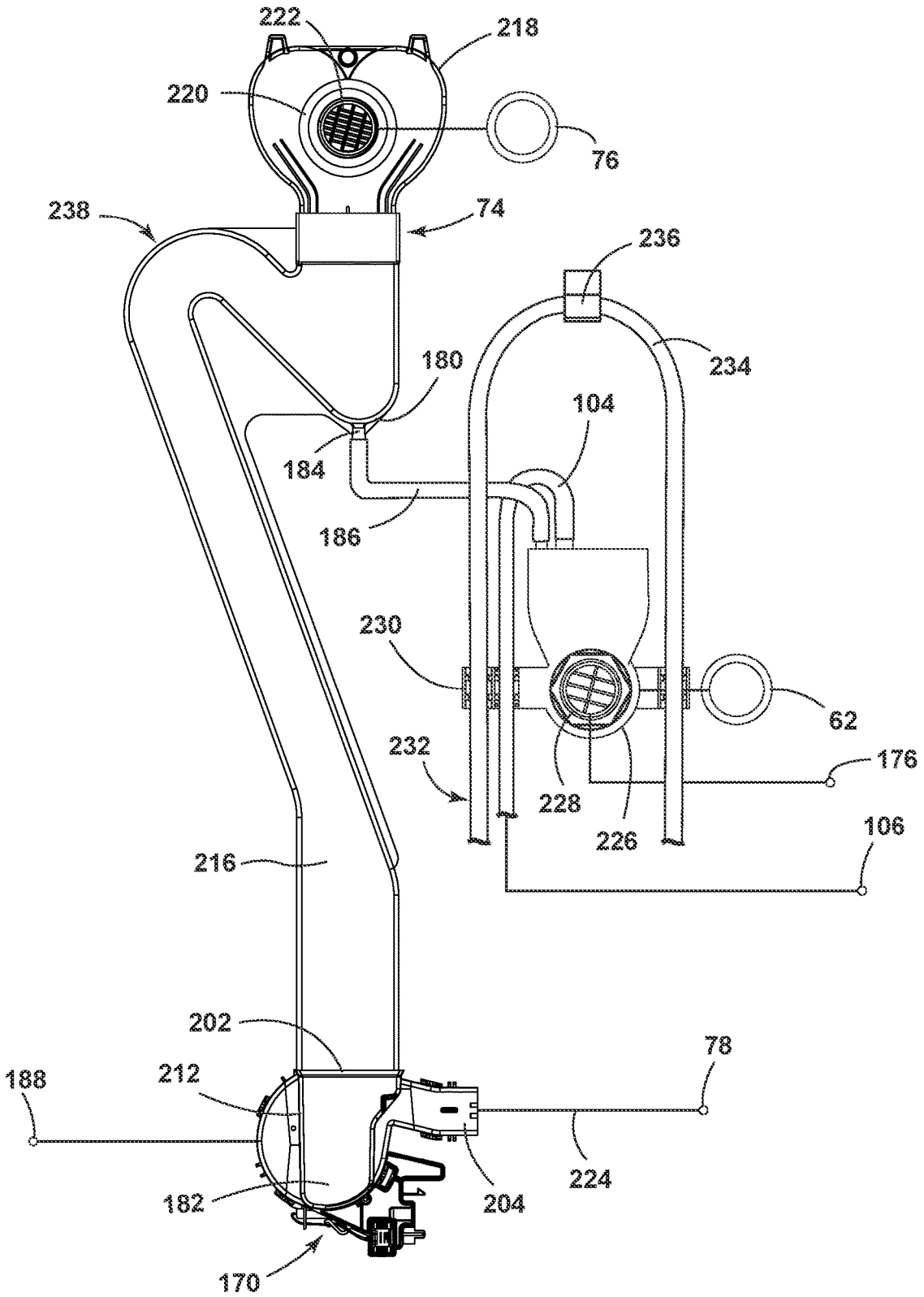
FIG. 19 is a side view of the air system of FIG. 16.

The blower assembly 170 may be coupled to conduits and other components forming the airflow conduit of the air system. FIG. 19 provides a view of the side of the air system facing the dishwasher 10 and more clearly illustrates the components of the air system. For example, the inlet opening 202 of the blower assembly 170 may be mounted to an outlet conduit 216 connected to a tub outlet housing 218 having an opening 220 coupled to the tub outlet 76. The opening 220 may include louvers 222, optionally, to force the airflow in a desired direction. Additionally, the outlet opening 204 of the blower assembly 170 may be coupled to an exhaust conduit 224 that directs the air to the exhaust outlet 78. A tub inlet housing 226 having an opening 228 coupled to the tub inlet 62 may receive air from the vent 176.

In addition, the liquid supply conduit 104 may be connected to the tub inlet housing 228 to fluidly couple the liquid supply 106 to the tub inlet 62. Optionally, a conduit bracket 230 may be integrally formed with or attached to the tub inlet housing 226 to secure the liquid supply conduit 104 in place. The conduit bracket 230 may also be configured to secure other conduits, such as a drain conduit 232, if desired. In the illustrated embodiment, the conduit bracket 230 secures two portions of the drain conduit 232 in order to form a loop 234 which is further secured by a loop bracket 236 above the conduit bracket 230. The secured loop 234 of the drain conduit 232 prevents undue shortening of the drain conduit 232 during installation.

The outlet conduit section 74 includes a dogleg 238, and the first reservoir 180 lies upstream of the dogleg 238 and the second reservoir 182 lies downstream of the dogleg 238. The dogleg 238 can be formed by the outlet conduit 216 and creates a serpentine airflow path to effect separation of moisture from the mixed air received from the tub outlet 76.

The first reservoir 180 is defined by a portion of the outlet conduit 216 upstream of the dogleg 238. A downstream portion of the outlet conduit 216 couples with the inlet housing 212 of the blower assembly 170, which defines the second reservoir 182.

Figure 20:
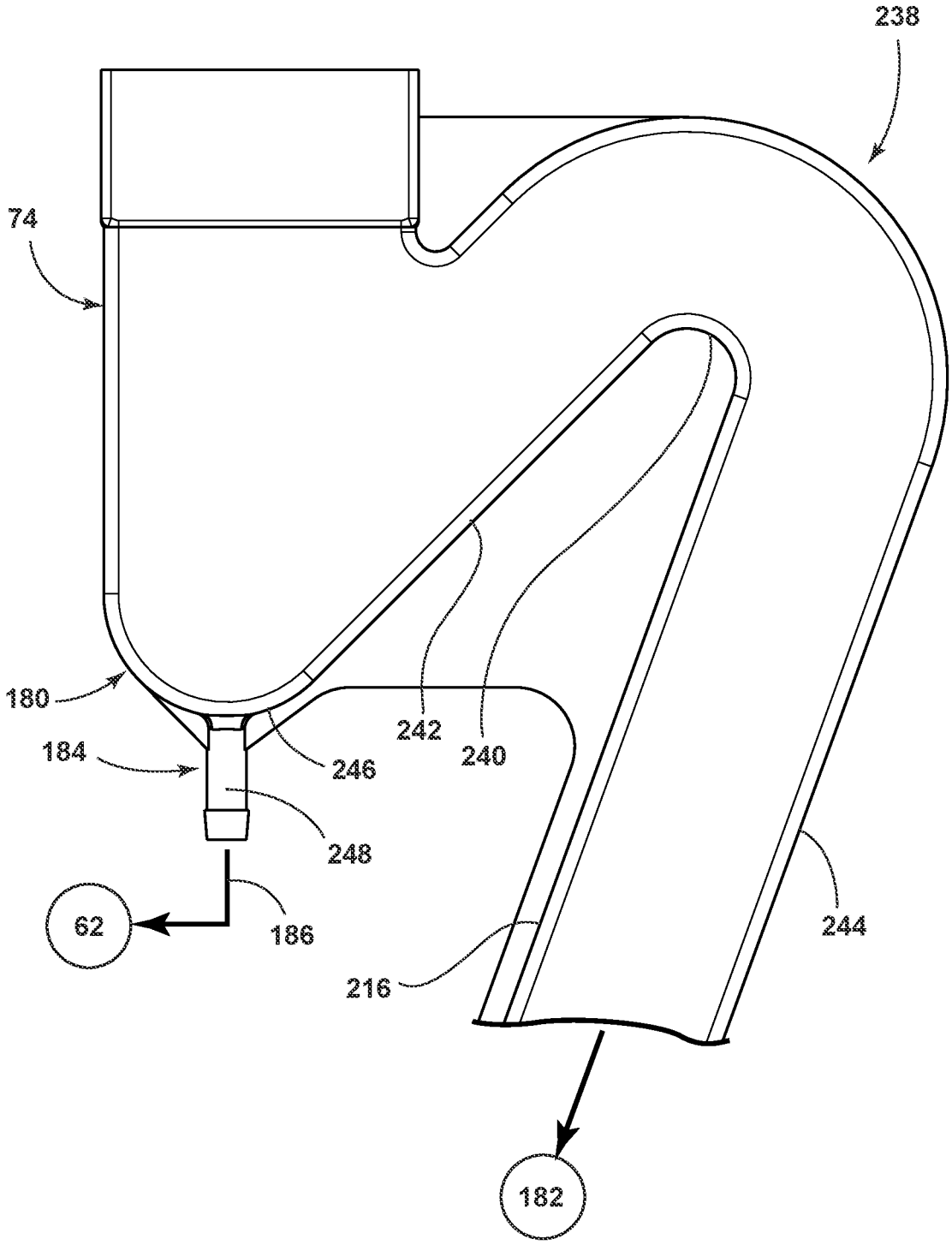
FIG. 20 is an enlarged view of a dogleg in the air system of FIG. 16.

FIG. 20 is an enlarged view of the dogleg 238 in the air system of FIG. 16. The dogleg 238 can include a sharp bend 240 in the outlet conduit section 74. The bend 240 can generally be defined by an acute angle, such that there is an abrupt change in the direction for the air flowing through the outlet conduit section 74. Approaching the bend 240, the outlet conduit 216 includes a first sloped lower wall 242. Leaving the bend 240, the outlet conduit 216 may include a second sloped lower wall 244. While some moisture begins to collect as soon as the mixed air enters the outlet conduit section 74, the sharp bend 240 causes additional moisture to condense. Even moisture that may condense after passing the first reservoir 180 may be collected in the first reservoir 180 due to the first sloped lower wall 242, which directs liquid that has not crossed the bend 240 to flow back into the first reservoir 180. Likewise, the second sloped lower wall 244 directs liquid that has crossed the bend 240 into the second reservoir 182.

The first reservoir 180 may be integrally formed with the outlet conduit 216 by a reservoir housing 246. The liquid outlet 184 is provided at a nadir of the first reservoir 180, particularly at a nadir of the reservoir housing 246, such that the liquid in the reservoir 180 may flow downward due to gravity and exit the outlet conduit 216 through the liquid outlet 184. The liquid outlet 184 can comprise an outlet tube 248 connected with the drain conduit 186 leading to the tub inlet 62 such that the condensed liquid may drain into the treating chamber 16 through the tub inlet 62.

While the operation of the air system shown in FIGS. 15-20 is apparent from the above description of the previous embodiments and the detailed explanation of the blower assembly 170 and collector 178, a brief summary follows with combined reference to FIGS. 15-20. Most of the components mentioned below in conjunction with the operation are viewable in FIG. 19; other components are viewable in the other figures. Rotation of the impeller 172 by the blower motor 174 draws the air from the treating chamber 16 through the tub outlet 76 into the outlet section 74 of the airflow conduit. Make-up ambient air flows into the inlet section 60 of the airflow conduit through the vent 176. The ambient air flows into the tub inlet housing 226, where the ambient air enters the tub 14 through the tub inlet 62. The heated ambient air mixes with humid air inside the treating chamber 16 to form mixed air.

The mixed air drawn into the outlet section 74 of the airflow conduit. The mixed air flows through the outlet conduit 216 and through the dogleg 238. Some of the moisture in the mixed air may condense and collect in the first reservoir 180. The air then enters the inlet opening 202 into the impeller chamber 200. Some of the moisture in the mixed air may condense and collect in the second reservoir 182. In particular, any liquid that condenses from the air that is not collected by the first reservoir 180 is collected by the second reservoir 182. Some ambient air may flow through the second vent 188 to further combine with the mixed air and lower the temperature of the air prior to the air passing through the outlet opening 204 to the exhaust outlet 78. The exhaust outlet 78 directs the air out of the dishwasher 10, such as forwardly of the dishwasher 10 below the tub 14 and the door assembly 18 (FIG. 15). The reduction in the humidity of the air due to the collector 178 results in reduced undesired condensation on areas and surfaces surrounding the exhaust outlet 78. The liquid collected in the first reservoir 180 can drain directly into the tub 14. The liquid collected in the second reservoir 182 evaporates over time, although in some embodiments the ambient air drawn in through the second vent 188 by the blower 170 during the cycle of operation may also aid in the evaporation of some of the liquid collected in the second reservoir 182.

The embodiments of the air system shown in FIGS. 15-20 provide several advantages. The collector 178 includes dual reservoirs 180, 182 to collect moisture condensed from the air before it is exhausted from the dishwasher 10. The inclusion of dual reservoirs increases the capacity of the collector, allowing the dishwasher to handle more condensation. The increased capacity and back-up style configuration of the collector 178 allows for more robust installation variations as some installation locations may be prone to more condensation than others. For example, in one household with high condensation conditions, both reservoirs 180, 182 may be utilized to capacity. In another household with low condensation conditions, the second reservoir 182 may find little use. Condensation or spilling of liquid outside the dishwasher can be prevented.

As mentioned above, many embodiments of the air system have been shown and described herein, and the various elements of the embodiments may be combined in any suitable manner to form a desired air system. Such modifications may also include connecting the various conduits, housings, etc. to one another in any desired location relative to each other, i.e., upstream or downstream. The schematic drawings include circles that depict inlet and outlet openings and arrows that represent airflow. These symbols are not meant to limit these features in any manner. For example, the openings are not limited to the size, shape, or position shown in the illustrations. The arrows are meant to show direction of airflow and general behavior with respect to mixing and combining. The arrows do not limit the exact locations of air mixing and combining, are not intended to represent air pressure at a certain location in the airflow conduit, and do not preclude the addition or subtraction of other elements that incorporate further mixing or combining of air or remove mixing or combining of air. In addition, some elements of the airflow conduit have been identified as housings, and the housings effectively form a conduit through which air passes; therefore, reference to a conduit may also refer to a housing as long as air flows through the housing.

To the extent not already described, the different features and structures of the various embodiments of the air system may be used in combination with each other as desired. That one feature may not be illustrated in all of the embodiments of the air system is not meant to be construed that it cannot be, but is done for brevity of description. Thus, the various features of the different embodiments of the air system may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher, comprising:

a tub having an open face and at least partially defining a treating chamber receiving dishes for treatment and having a tub air outlet;

a collector located in an airflow conduit that fluidly couples the tub air outlet to ambient air, the collector comprising:

a first reservoir associated with the airflow conduit, the first reservoir configured for collecting liquid condensed from air forced, via a blower assembly, through the airflow conduit and defining an open reservoir having a liquid outlet fluidly coupled to the tub and configured for draining collected liquid in the open reservoir into the tub; and a second reservoir associated with the airflow conduit, the second reservoir located downstream of the first reservoir and at a height vertically below the liquid outlet of the first reservoir, the second reservoir configured for collecting liquid condensed from the air forced through the airflow conduit and defining a closed reservoir configured for emptying collected liquid via evaporation; and a pump fluidly coupled to the first reservoir and configured to actively drain the first reservoir into the tub;

wherein the airflow conduit includes a dogleg portion that is fluidly downstream of the first reservoir and fluidly upstream of the second reservoir.

2. A dishwasher, comprising:

a tub having an open face and at least partially defining a treating chamber receiving dishes for treatment and having a tub air outlet and a tub air inlet;

an air system, comprising:

an airflow conduit fluidly coupling the tub air outlet to ambient air;

a first reservoir associated with the airflow conduit, the first reservoir configured for collecting liquid condensed from the air forced through the airflow conduit and defining an open reservoir having a liquid outlet fluidly coupled to the tub and configured for draining collected liquid in the open reservoir into the tub;

a second reservoir associated with the airflow conduit, the second reservoir located downstream of the first reservoir and at a height vertically below the liquid outlet of the first reservoir, the second reservoir configured for collecting liquid condensed from the air forced through the airflow conduit and defining a closed reservoir configured for emptying collected liquid via evaporation; and a blower assembly forcing air to flow from the tub through the tub air outlet into the airflow conduit and to ambient air, the blower assembly fluidly located between the first reservoir and the ambient air, and wherein during operation the first reservoir and the second reservoir collect the liquid condensed from the air before the blower assembly exhausts to the ambient air; and a pump fluidly coupled to the first reservoir and configured to actively drain the first reservoir into the tub.

3. The dishwasher of claim 2 wherein the first reservoir is located on a sidewall of the tub and the second reservoir is located below the tub.

4. The dishwasher of claim 2 wherein the second reservoir is downstream of the first reservoir and any liquid not collected by the first reservoir is collected by the second reservoir allowing for increased capacity within the air system.

5. The dishwasher of claim 2 wherein the airflow conduit comprises a dogleg defined by an at least partially inverted U-shape having a sharp bend and the first reservoir lies upstream of the dogleg and the second reservoir lies downstream of the dogleg.

6. The dishwasher of claim 5 wherein the first reservoir is defined by a portion of the dogleg up to the sharp bend.

7. The dishwasher of claim 6 wherein dogleg after the sharp bend directs liquid into the second reservoir.

8. The dishwasher of claim 7 wherein the liquid outlet is at a nadir of the first reservoir.

9. The dishwasher of claim 2 wherein the second reservoir is fluidly located between the first reservoir and the blower assembly.

10. A dishwasher, comprising:

a tub having an open face and at least partially defining a treating chamber receiving dishes for treatment and having a tub air outlet;

a spray system configured to spray liquid into the dishwasher;

an air system, comprising:

an airflow conduit comprising an inlet section fluidly coupling ambient air to the treating chamber through a tub air inlet formed in the tub and an outlet section fluidly coupling the tub air outlet to ambient air;

a blower assembly forcing air to flow from the tub and through the tub air outlet into the outlet section;

a first reservoir within the outlet section of the airflow conduit, the first reservoir configured to collect liquid condensed air forced through the outlet section, the first reservoir fluidly coupled to the tub and configured for draining the collected liquid into the tub; and a second reservoir within the airflow conduit downstream of the first reservoir and configured to collect any liquid not collected by the first reservoir for evaporation prior to exhaustion of the air to the ambient air; and a pump fluidly coupled to the first reservoir and configured to actively drain the first reservoir into the tub.

11. The dishwasher of claim 10 wherein the second reservoir is formed by a portion of the blower assembly.

12. The dishwasher of claim 11 wherein the blower assembly comprises at least one impeller operably coupled to a motor, the at least one impeller effecting a flow of ambient air into the airflow conduit.

13. The dishwasher of claim 10 wherein the first reservoir is fluidly coupled to the tub via the inlet section of the airflow conduit.

14. The dishwasher of claim 13 wherein the tub air outlet is vertically positioned higher than the tub air inlet.

15. The dishwasher of claim 14 wherein the first reservoir is located vertically between the tub air outlet and the tub air inlet.

16. The dishwasher of claim 10 wherein the airflow conduit comprises a dogleg defined by an at least partially inverted U-shape having a sharp bend and the first reservoir lies upstream of the dogleg and the second reservoir lies downstream of the dogleg.

17. The dishwasher of claim 16 wherein the first reservoir is defined by a portion of the dogleg up to the sharp bend.

18. The dishwasher of claim 17 wherein the dogleg after the sharp bend directs liquid into the second reservoir.

* * * * *